US008333300B2

(12) United States Patent
Diaz

(10) Patent No.: US 8,333,300 B2
(45) Date of Patent: Dec. 18, 2012

(54) APPLYING A FLUID

(75) Inventor: Alejandro Diaz, San Francisco, CA (US)

(73) Assignee: Alejandro Diaz, San Francisco, CA (US)

( * ) Notice: Subject to any disclaimer, the term of this patent is extended or adjusted under 35 U.S.C. 154(b) by 832 days.

(21) Appl. No.: 11/897,730

(22) Filed: Aug. 31, 2007

(65) Prior Publication Data

US 2008/0054030 A1 Mar. 6, 2008

Related U.S. Application Data

(60) Provisional application No. 60/841,878, filed on Sep. 1, 2006.

(51) Int. Cl.
*B65D 23/12* (2006.01)

(52) U.S. Cl. ..... 220/769; 220/696; 220/697; 220/710.5; 220/741; 220/752; 220/755; 211/65; 248/110; 248/113; 248/213.2; 248/312.1

(58) Field of Classification Search ..... 220/697, 220/769, 696, 710.5, 741, 752, 755; 248/110, 248/113, 213.2, 312.1, 311.2
See application file for complete search history.

(56) References Cited

U.S. PATENT DOCUMENTS 2,461,825 A * 2/1949 Kowalski ..... 248/210
2,786,707 A * 3/1957 Campbell ..... 294/34
3,987,993 A * 10/1976 Hopkins ..... 248/210
4,962,906 A * 10/1990 Fatool et al. ..... 248/148
4,993,675 A * 2/1991 Walker ..... 248/311.2
5,083,733 A * 1/1992 Marino et al. ..... 248/110
6,431,509 B1 * 8/2002 Proulx ..... 248/210
6,929,225 B1 8/2005 Kent

OTHER PUBLICATIONS

Title: "Industrial Magnetic Devices", The Magnetic Source, Date: Apr. 1, 2003, (pp. 1-23, See p. 9) Company: Master Magnetics, Inc., Address: 607 S. Gilbert St., Castle Rock, CO 80104.
Title: "FoamPRO—New Products", Date: May 7, 2006, (No. of pp. 2) URL: http://web.archive.org/web/20060507172314/http://www.foampromfg.com/newProducts.htm Company: FoamPRO Mfg. Co., Address: P.O. Box 18888, Irvine, CA 92623-8888.
Title: "HANDy Paint Pail—Painting just got easier!", Date: Aug. 13, 2006, (No. of pp. 2) URL: http://web.archive.org/web/20060813023829/http://handypaintpail.com/ Company: Bercom, Address: 1709 Lake Drive West, Chanhassen, MN 55317.
Title: "Flexi: The Paint Can Spout, The Original Fits-All Paint Sprout", Date: Nov. 5, 2007, (No. of pp. 4) URL: http://www.flexiproducts.com Company: Sven O. Olsson Engineering Co.

* cited by examiner

*Primary Examiner* — Anthony Stashick
*Assistant Examiner* — Elizabeth Volz
(74) *Attorney, Agent, or Firm* — David Lewis

(57) ABSTRACT

In an embodiment, a holder for an applicator for a fluid may include a magnet for holding the applicator over the container. The holder for the applicator may attach to the rim of the container or may be attached to a container holder. The container holder may include a handle and may be used with a container having bucket handles. In an embodiment, the container holder may include a band with notches for receiving a pivot where the handles connect to the container. In an embodiment, the container holder may include a clip for attaching to a ladder and/or may not necessarily include a applicator holder.

3 Claims, 21 Drawing Sheets

Detail N°1

Detail N°2

Detail N°1

Sectional View

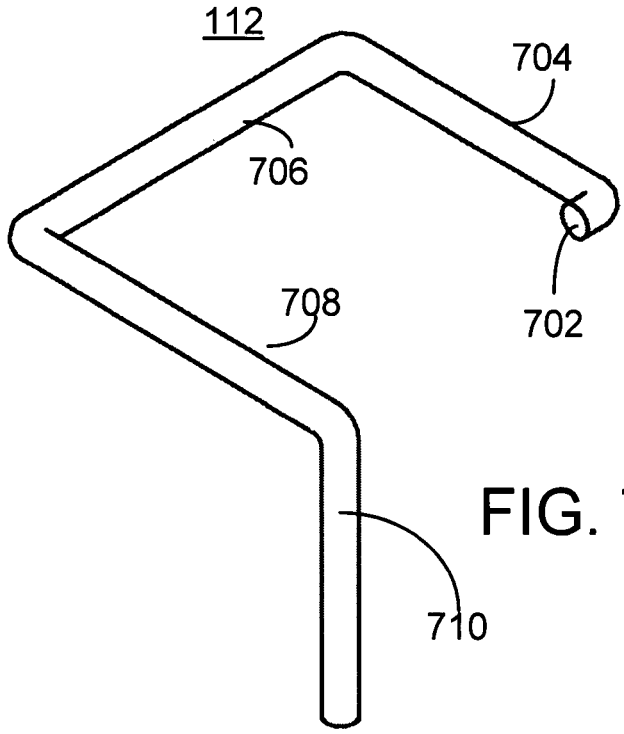
FIG. 7
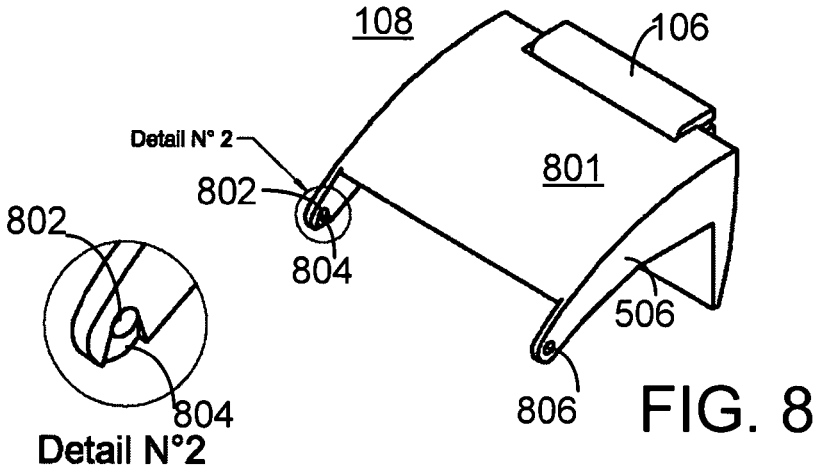
FIG. 8
FIG. 9
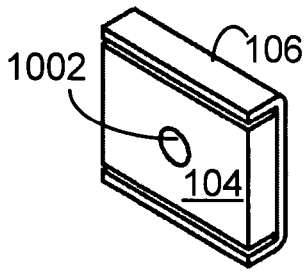
FIG. 10
Magnet

Detail N°1

FIG. 14
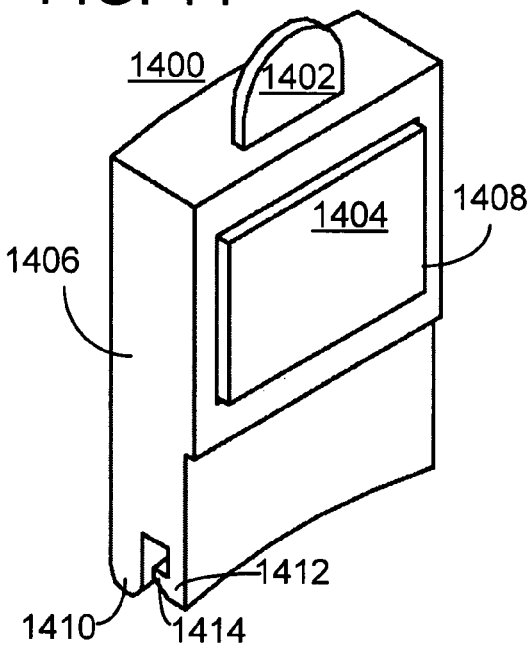
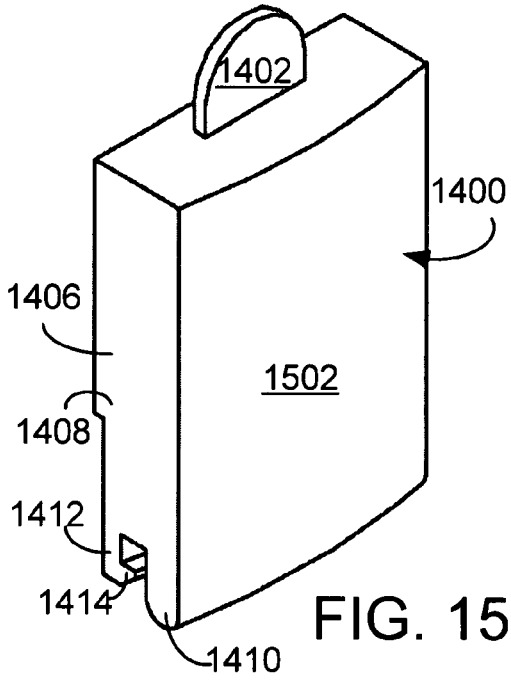
FIG. 15
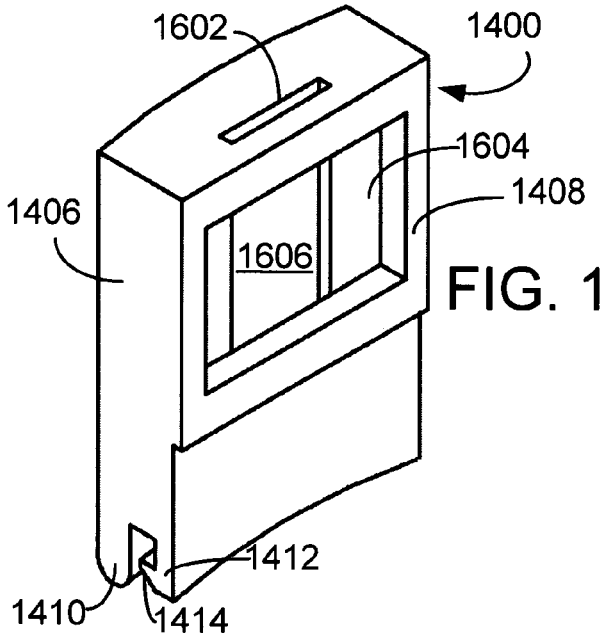
FIG. 16A

FIG. 17
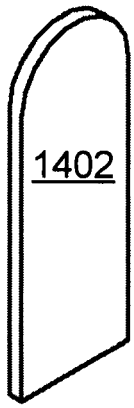
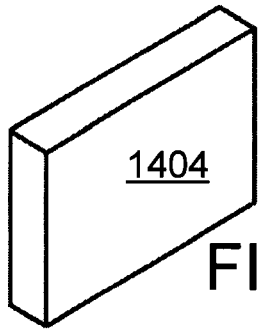
FIG. 18
FIG. 19
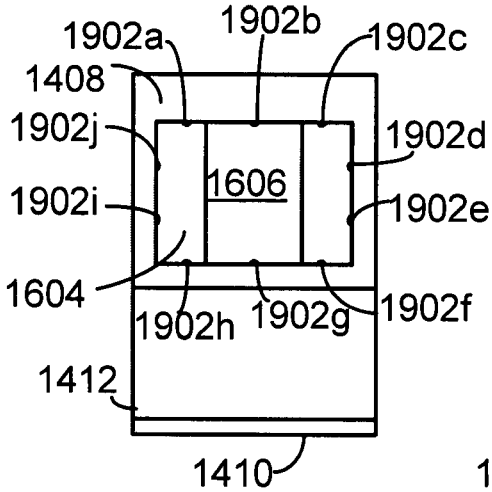
Front View
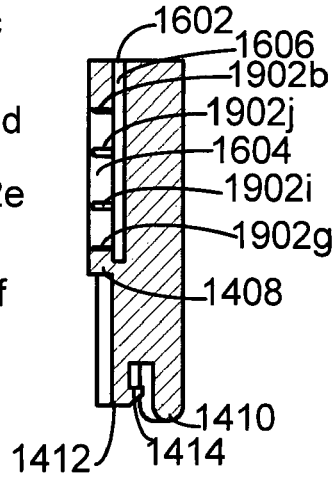
Sectional View
FIG. 20
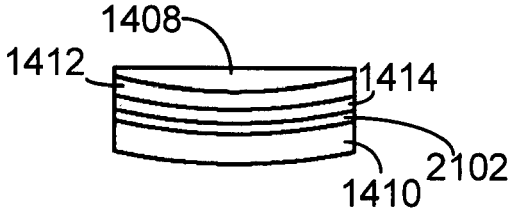
Bottom View
FIG. 21

Piece N°2

Top View FIG. 31A

Detail N°2
Scale 2:1

Front View FIG. 31B

Side View FIG. 31E

Botton View FIG. 31C

Piece N°3
Scale 1:2

Top View FIG. 31G

Sectional View FIG. 31D

Front View

APPLYING A FLUID

CROSS-REFERENCE TO RELATED APPLICATIONS

This application claims priority benefit of U.S. Provisional Patent Application, entitled, "APPLYING A FLUID," Ser. No. 60/841,878, by Alejandro Diaz, filed Sep. 1, 2006, which is incorporated herein by reference.

BACKGROUND OF THE DISCLOSURE

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

While painting or applying other fluids, although the container may come with a handle, the handle may not be convenient for using while applying the fluid. In some situations it may desirable to place the fluid applicator near the container without making a mess. One may want to lay the applicator in the container in the fluid within. However, if the container is full, for example, the applicator may fall in to the fluid and the handle may be covered with the fluid making the applicator undesirable to use.

BRIEF DESCRIPTION OF THE DRAWINGS

In the following drawings like reference numbers are used to refer to like elements. Although the following figures depict various examples of the invention, the invention is not limited to the examples depicted in the figures.

FIG. 7 shows a diagram of a representation of an embodiment of the clip of FIGS. 1A, 1B, 5, and 8.

FIG. 8 shows another view of the applicator holder of FIGS. 1A, 1B, 5, and 8.

FIG. 9 shows a diagram of a representation of an embodiment of a detail of the applicator holder of FIG. 8.

FIG. 10 shows a diagram of a representation of an embodiment of another view of the magnet and magnet holder of FIGS. 1A, 5, and 8.

FIG. 14 shows a diagram of a representation of an embodiment of an applicator holder.

FIG. 15 shows a diagram of a representation of an embodiment of another view of the applicator holder FIG. 14.

FIG. 16A shows a diagram of a representation of an embodiment of another view of the applicator holder of FIG. 14.

FIG. 17 shows a diagram of a representation of an embodiment of a tung used in the applicator holders of FIG. 14.

FIG. 18 shows a diagram of a representation of an embodiment of a magnet used in the applicator holder of FIG. 14.

FIG. 19 shows a diagram of a representation of a front view of an embodiment of an applicator holder.

FIG. 20 shows a diagram of a representation of an embodiment of a sectional view of the applicator holder of FIG. 19.

FIG. 21 shows a diagram of a representation of an embodiment of a bottom view of the applicator holder of FIG. 14.

FIGS. 31A-31H show an embodiment the applicator holder and clip of FIG. 1A.

DETAILED DESCRIPTION

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

In general, at the beginning of the discussion of each of FIGS. 1-26 is a brief description of each element, which may have no more than the name of each of the elements in the one of FIGS. 1-26 that is being discussed. After the brief description of each element, each element is further discussed in numerical order. In general, each of FIGS. 1-30 is discussed in numerical order and the elements within FIGS. 1-30 are also usually discussed in numerical order to facilitate easily locating the discussion of a particular element. Nonetheless, there is no one location where all of the information of any element of FIGS. 1-30 is necessarily located. Unique information about any particular element or any other aspect of any of FIGS. 1-30 may be found in, or implied by, any part of the specification.

Figure 1A:
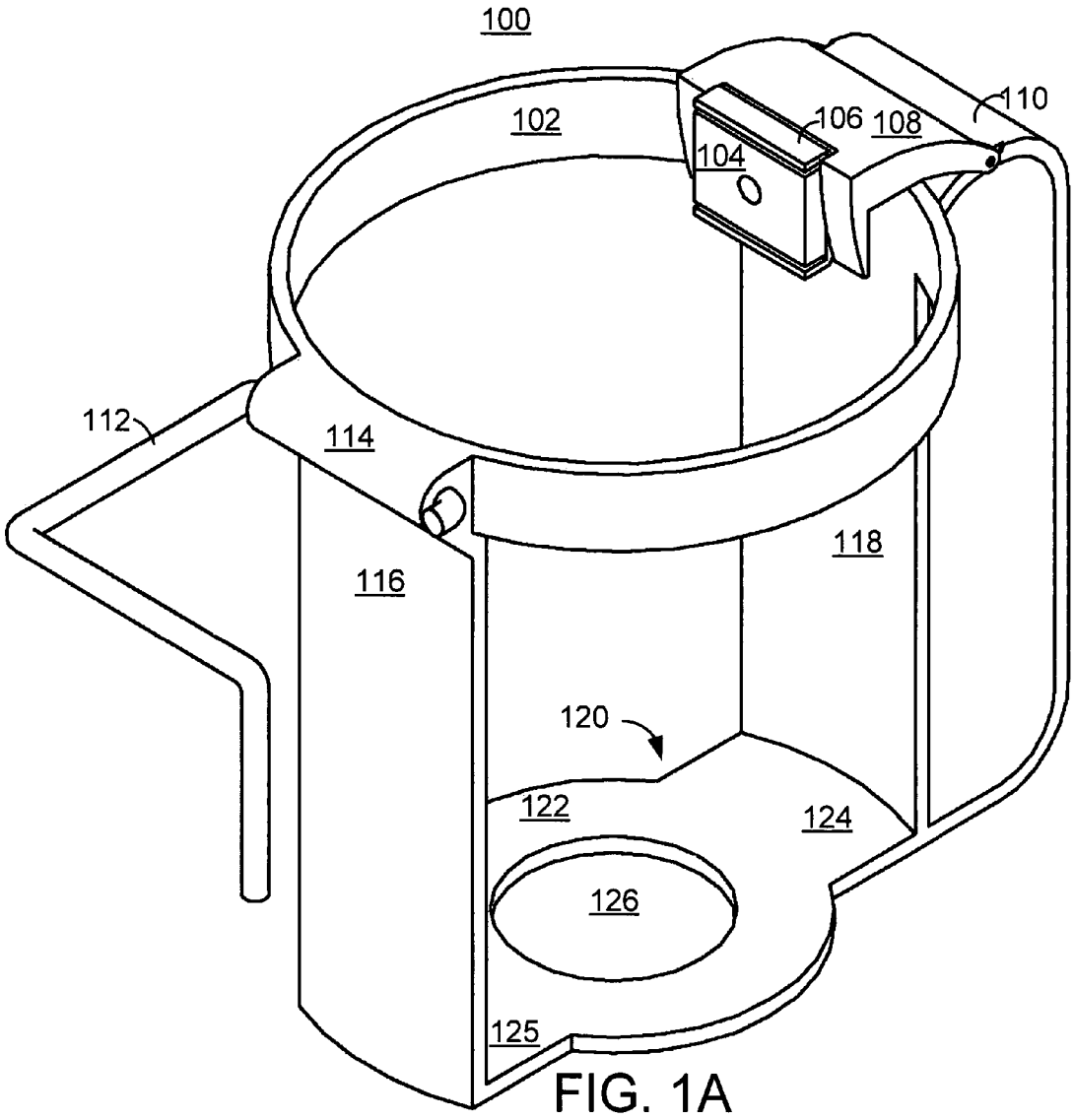
FIG. 1A shows a diagram of a representation of an embodiment of container holder.

FIG. 1A shows a diagram of a representation of an embodiment a container holder 100 having band 102, magnet 104, magnet holder 106, applicator holder 108, handle 110, clip 112, sleeve 114, straps 116 and 118, and bottom 120 having ring portion 122 and straight portions 124 and 125. Ring portion 122 has hole 126. In other embodiments, container holder 100 may not have all of the elements listed and/or may have other elements instead of or in addition to those listed.

Container holder 100 holds a container of a fluid and also holds an applicator for applying the fluid. For example, the fluid may be paint and the applicator may be a paint brush. Container holder 100 holds the container such that band 102 fits around the top of the container so that the container is unlikely to move around within container holder 100. In an embodiment, band 102 is $\frac{1}{8}^{th}$ of an inch thick of a hard plastic, and is $\frac{5}{8}^{th}$ of an inch wide. In general if not otherwise specified an embodiment of any of the parts of any of the components of the container applicators or container holders of this specification may be $\frac{1}{8}^{th}$ inch thick of hard plastic. In an embodiment, the outer radius of band 102 is 2¼ inches. In an embodiment, container holder 100 has a size and shape appropriate for holding a standard one gallon can of paint. Magnet 104 holds the applicator in place by sticking to portions of the applicator that are attracted to magnets. Magnet holder 106 forms a seat for the magnet, which helps hold magnet 104 in one place. Applicator holder 108 includes magnet 104 and magnet holder 106, and via magnet 104 holds the applicator over the container. In an embodiment, applicator holder 108 is $1\frac{19}{32}^{nd}$ of an inch wide and $1\frac{3}{8}^{th}$ of an inch long.

In an embodiment, a handle 10 is attached to container holder 100, such that handle 110 is located on the side of the container. Using handle 110, the container may be held in a convenient location (via one hand) while applying the fluid. Although often cans of paint or other fluids come with their own bucket-type handle, holding the can of paint or other fluid via the bucket-type of handle (that typically comes with the can of paint) may be awkward and inconvenient while painting or applying another type of fluid. In an embodiment the top inside portion of handle 110 is curved and has an inside radius of ½ inch.

Clip 112 clips to the step of a ladder thereby holding the container in a convenient location applying the fluid (e.g., while painting). In an embodiment, clip 112 has a diameter of $\frac{3}{32}^{nd}$ of an inch. Clip 112 may engage either side of a ladder. Sleeve 114 secures clip 112 to container holder 100. In an embodiment, sleeve 114 holds clip 112 at a distance of $\frac{1}{8}^{th}$ of an inch from the location of where the outside of band 102 would be located were sleeve 114 not present, which is a radial distance of $2\frac{3}{8}^{th}$ of an inch from the center of the circle formed by band 102. Clip 112 has a portion that pivots within sleeve 114.

Straps 116 and 118 hold band 102 to a bottom portion, which together act as a holder for the container. In an embodiment, straps 116 and 118 extend a length of $4\frac{15}{32}^{nd}$ of an inch from the bottom of band 102 to the undersurface of container holder 102. Strap 118 may also be a portion of handle 110. In an embodiment, the outer surface of the bottom of strap 118 (which is an inner surface of handle 110) forms a 90 degree angle with another connecting inner surface at the bottom of handle 110. The bottom surface of handle 110 is connected to the outer vertical surface of handle 110 by a curved portion having an inner radius of ½ inch. Bottom 120 is attached to straps 116 and 118. Straight portions 124 and 125 attach to straps 116 and 118 and to ring portion 122. Straight portions 124 and 125 in combination with ring portion 122 support the bottom of the container. Optionally, ring portion 122 may include hole 126 to save the amount of material required for making container holder 122. In an embodiment hole 126 has a radius of $\frac{13}{16}^{th}$ of an inch.

Figure 1B:
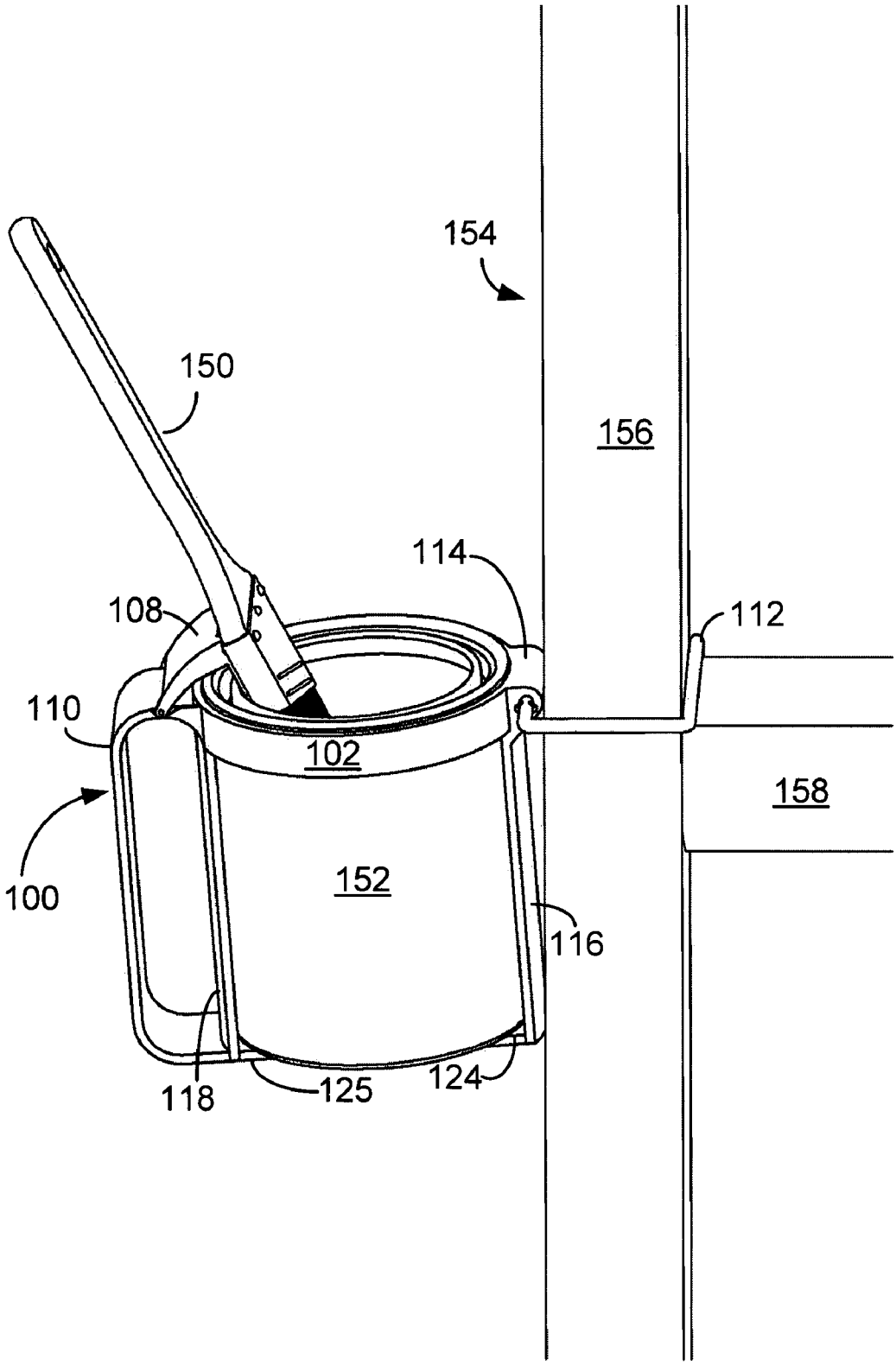
FIG. 1B shows a diagram of a representation of an embodiment of the container holder of FIG. 1A attached to a ladder.

FIG. 1B shows a diagram of a representation of an embodiment of a system including container holder 100 having band 102, applicator holder 108, handle 110, clip 112, sleeve 114, straps 116 and 118, and straight portions 124 and 125. The system of FIG. 1B also includes applicator 150, applicator container 152, and ladder 154 having leg 156 and step 158. In other embodiments, the system of FIG. 1B may not have all of the elements listed and/or may have other elements instead of or in addition to those listed.

Container holder 100 having band 102, applicator holder 108, handle 110, clip 112, sleeve 114, straps 116 and 118, straight portions 124 and 125 were described in conjunction with FIG. 1A, above. Applicator 150 is for applying a fluid. In an embodiment, applicator 150 may be a paint brush. Container 152 contains the fluid being applied. In an embodiment, container 152 is a one gallon paint can. Ladder 154 may be used for applying the fluid to a wall, for example. Step 158 is one of the steps of ladder 154. Leg 156 is one of the legs of ladder 154, and leg 156 helps hold the steps of ladder 154 in place. FIG. 1B shows the manner in which applicator holder 100 attaches to a ladder. Specifically, clip 112 wraps around leg 156 and hooks onto step 158.

Figure 2:
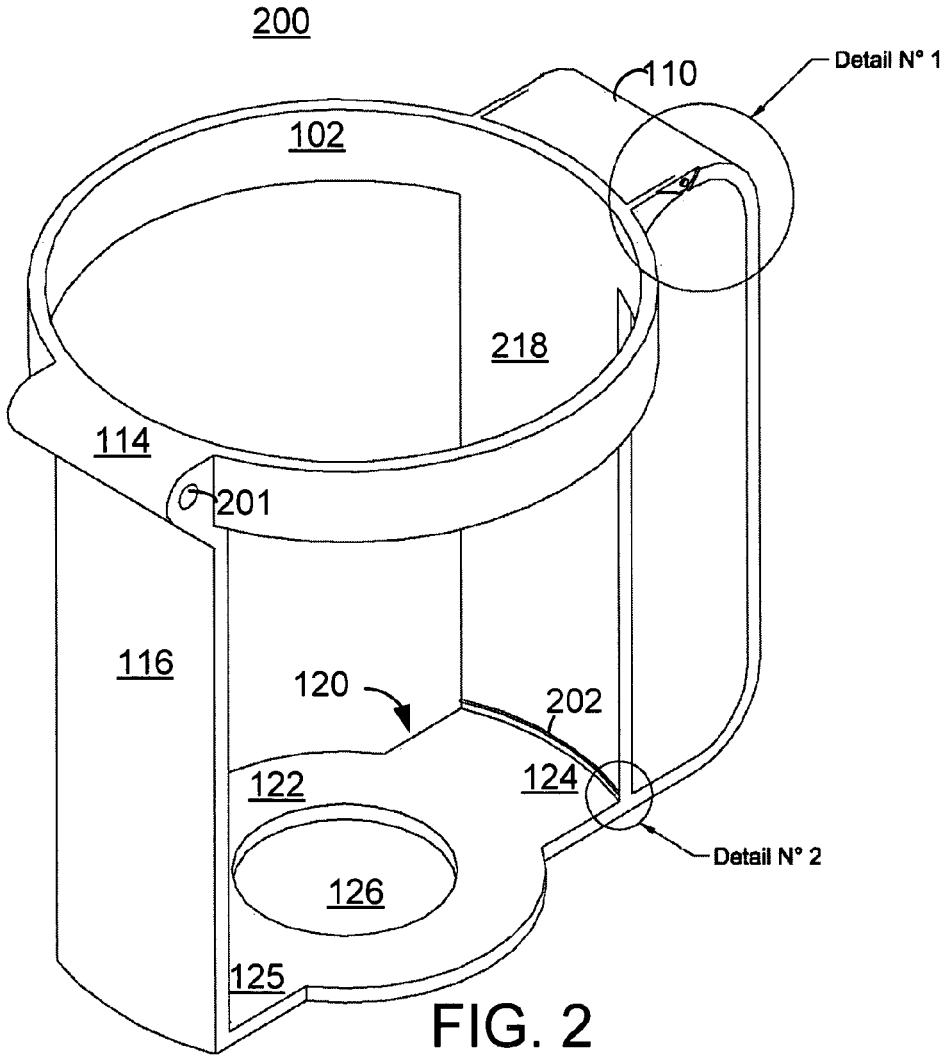
FIG. 2 shows a diagram of a representation of another embodiment of a container holder.

FIG. 2 shows a diagram of a representation of an embodiment of container holder 200 having band 102, handle 110, sleeve 114, straps 116 and 218, and bottom 120 having ring portion 122 and straight portions 124 and 125, where ring portion 122 has hole 126. Container holder 200 also includes detail no. 1, detail no. 2, channel 201, and cylindrical bump 202 on strap 218. In other embodiments, container holder 200 may not have all of the elements listed and/or may have other elements instead of or in addition to those listed.

Container holder 200 is the same as holder 100 except that container holder 200 has at least one cylindrical bump to hold the container in place. Otherwise container holder 200 is the same as holder 100. Container holder 200 is depicted without applicator holder 108 and without clip 112 so that the features hidden from view by applicator holder 108 and clip 112 can be seen (FIG. 1A).

Band 102, magnet 104, magnet holder 106, applicator holder 108, handle 110, sleeve 114, strap 116 and 118, bottom 120, ring portion 122, straight portions 124 and 125, ring portion 122 and hole 126 were discussed in conjunction with FIG. 1A, above.

Channel 201 is located within sleeve 114 and holds the portion of clip 112 that is located within sleeve 114. In an embodiment, channel 201 has an inner radius of $\frac{3}{32}^{nd}$ of an inch and an outer radius of $\frac{7}{32}^{nd}$ of an inch. In an embodiment, the outer surface of sleeve 114 makes a 45 degree angle with the outer surface of strap 116 at a point below channel 201. Cylindrical bump 202 presses against the container to hold the container snugly in place. In an embodiment, the center of cylindrical bump 202 is $\frac{5}{32}^{nd}$ of an inch above the top surface of bottom 120. In an embodiment, cylindrical bump 202 has a radius of $\frac{1}{32}^{nd}$ of an inch. Strap 218 is the same as strap 118 except that strap 218 has cylindrical bump 202. Optionally, cylindrical bump applies a force compressing the container and/or pushing strips 216 and 118 outwards holding the container in place. Optionally, strap 116 also has a cylindrical bump. In an embodiment, the handle is attached to a holder for the container. In this specification, in other embodiments, any of the bumps of other shapes in this specification, such as spherical, tetragonal, cubical, disk shaped, and/or another shape may be used instead of and/or in addition to any of the cylindrical shaped bumps. Detail No. 1 shows the connector that connects applicator holder 108 to container holder 200. The other side of container holder 200 has a similar feature to detail no. 1, which is a mirror image of detail no. 1. Detail no. 2 includes a portion of cylindrical bump 202.

Figure 3:
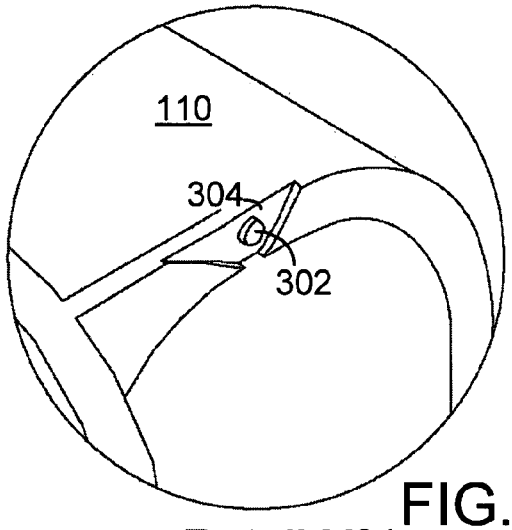
FIG. 3 shows an enlarged view of a representation of an embodiment of a detail of FIG. 2.

FIG. 3 shows a diagram of a representation of an embodiment of an enlarged view of detail no. 1 of FIG. 2, which includes a portion of handle 110 (FIG. 1) having pin 302 and depression 304. In other embodiments, container detail no. 1 may not have all of the elements listed and/or may have other elements instead of or in addition to those listed.

Applicator holder 108 pivots on pin 302 and the corresponding pin on the other side of container holder 100. Pin 302 sits in depression 304, which receives a tab having a hole that engages pin 302. In an embodiment, pin 302 is $1/32^{nd}$ of an inch tall and depression 304 is $1/32^{nd}$ of an inch deep. In an embodiment, pin 302 has a radius of $1/32^{nd}$ of an inch. In an embodiment, the top of depression 304 is $15/32^{nd}$ of an inch wide, and the bottom of depression 304 is $3/16^{th}$ of an inch wide. The center of pin 302 is half way between the two bottom edges of depression 304 and $2/3^{rd}$ of the way between the two top ends of depression 304.

Figure 4:
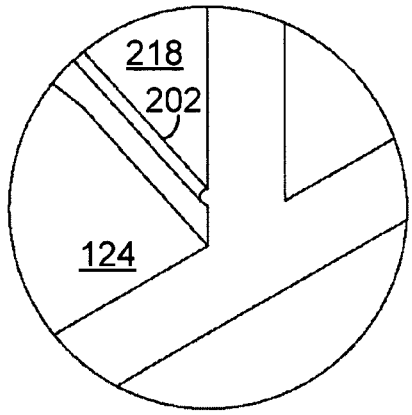
FIG. 4 shows an enlarged view of a representation of an embodiment of a detail of FIG. 2.

FIG. 4 shows a diagram of a representation of an embodiment an enlarged view of detail no. 2, which includes cylindrical bump 202 and strap 218, so that cylindrical bump 202 can be seen easier. In other embodiments, detail no. 2 may not have all of the elements listed and/or may have other elements instead of or in addition to those listed.

Figure 5:
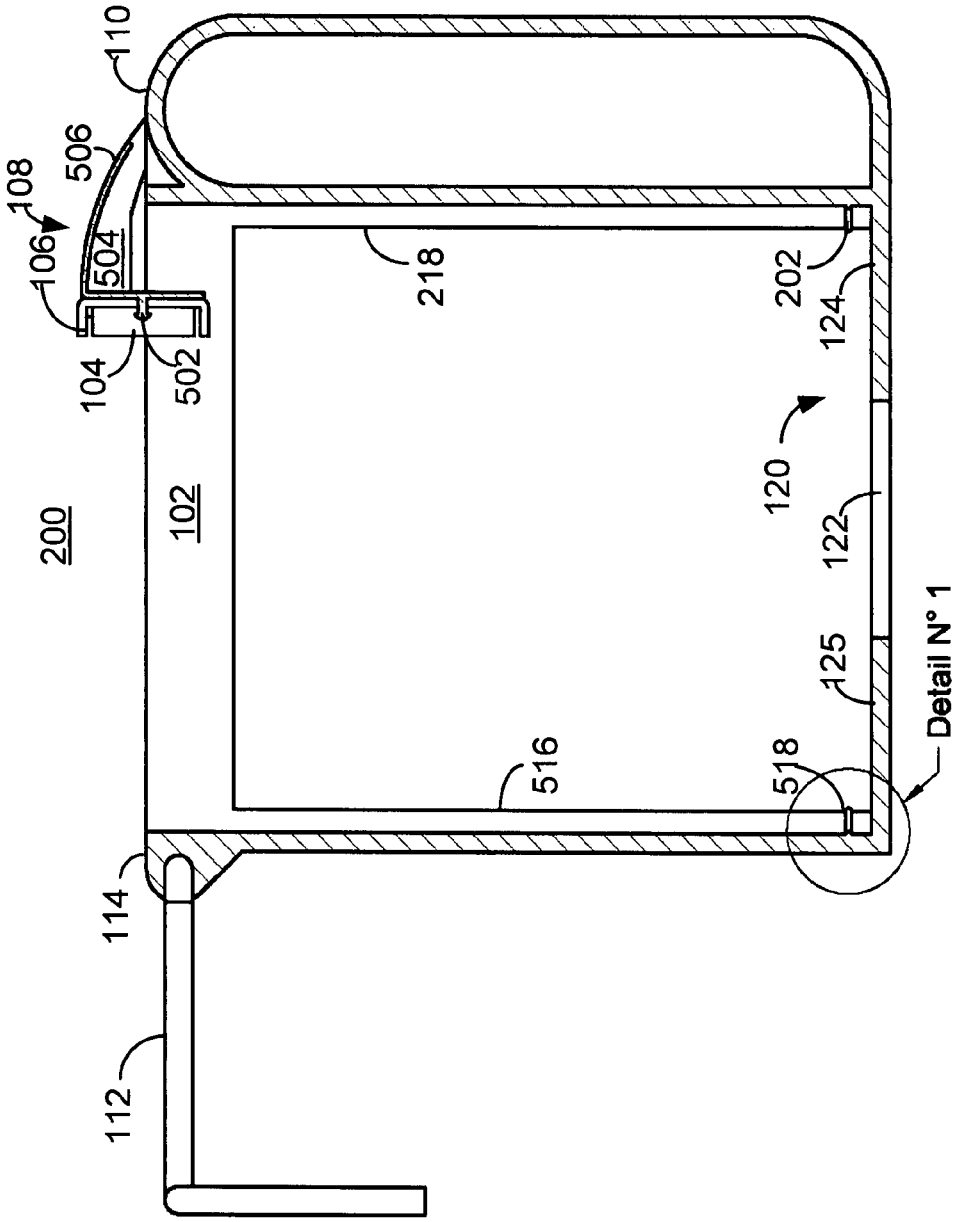
FIG. 5 shows a diagram of a representation of an embodiment of a cross sectional view of the container holder of FIG. 2.

FIG. 5 shows a diagram of a representation of an embodiment a cross section of an embodiment of container holder 200 having band 102, magnet 104, magnet holder 106, applicator holder 108, handle 110, clip 112, sleeve 114, and bottom 120 having ring portion 122 and straight portions 124 and 125, where ring portion 122 has hole 126. Applicator holder 108 also has pin 502 and sidewall 504. Container holder 200 also has strap 218 having cylindrical bump 202 and strap 516 having cylindrical bump 518.

Band 102, magnet 104, magnet holder 106, applicator holder 108, handle 110, clip 112, sleeve 114, strap 116, bottom 120, ring portion 122, straight portions 124 and 125, and hole 126 were discussed in conjunction with FIG. 1A. Applicator container holder 200 was discussed in conjunction with FIG. 2. The embodiment of applicator container holder 200 shown in FIG. 5 has two cylindrical bumps.

Pin 502 holds magnet 104 and magnet holder 106 to applicator holder 108. Sidewall 504 may help secure applicator holder 108 to container holder 100 or 200. Pin 502 is located ¾ of an inch from the inner surface of sidewall 504. In an embodiment, sidewall 504 is $1/16^{th}$ of an inch thick. In an embodiment the length of sidewall 504 is $1\frac{3}{8}^{th}$ of an inch. In an embodiment, the distance between the surface on which pin 502 sits and the end of sidewall 504 is $1/8^{th}$ of an inch. Strap 516 is an embodiment of strap 116 that has a cylindrical bump. In the cross sectional view of FIG. 5, cylindrical bump 518 is visible on strap 516. Having both cylindrical bumps 202 and 518 on container holder 200 secures the container in place better than just one cylindrical bump. Detail no. 1 is a portion of container holder 200 that includes a portion of strap 516 and cylindrical bump 518.

Figure 6A:
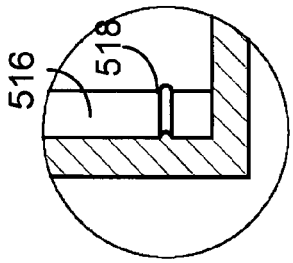
FIG. 6A shows an enlarged view of a representation of an embodiment of a detail of FIG. 5.

FIG. 6A shows a diagram of a representation of an embodiment of enlarged view of detail no. 1. Detail no. 1 includes strap 516 and cylindrical bump 518. In other embodiments, detail no. 1 may not have all of the elements listed and/or may have other elements instead of or in addition to those listed. Detail no. 1 shows a view in which strap 516 and cylindrical bump 518 can be seen more clearly than in FIG. 5.

Figure 6B:
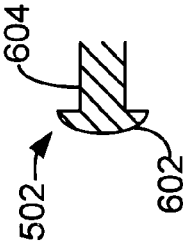
FIG. 6B shows a cross section of a representation of an embodiment of the pin of FIG. 5.

FIG. 6B shows a diagram of a representation of a cross section of pin 502 (FIG. 5) having head 602 and stem 604. Head 602 holds magnet 104 and magnet holder 106 (FIG. 1) from sliding off stem 604. In other embodiments, cross section of pin 502 may not have all of the elements listed and/or may have other elements instead of or in addition to those listed.

Stem 604 holds magnet 104 and magnet holder 106 from moving sideways in a direction perpendicular to the axis along which stem 604 lies. In an embodiment, stem 604 has a diameter of $1/16^{th}$ of an inch. In an embodiment the distance from the base of stem 604 to the bottom of head 602 is $3/32^{nd}$ of an inch. In an embodiment, the distance for the base of stem 604 to the top of head 602 is $5/32^{nd}$ of an inch.

FIG. 7 shows a diagram of a representation of an embodiment of clip 112 (FIG. 1) having portions 702-710. In other embodiments, clip 112 may not have all of the elements listed and/or may have other elements instead of or in addition to those listed.

Each of portions 702-710 are perpendicular to the other portions to which they are connected. Specifically, portion 702 is perpendicular to portion 704, which is perpendicular to portion 706, which is perpendicular to portion 708, which is perpendicular to portion 710. Portion 702 sticks out of one end of sleeve 114 and as a result of being bent holds clip 112 from slipping out of sleeve 114 in one direction (FIG. 1A). In an embodiment, the length of portion 702 from the end of portion 702 to the axis at the center of portion 704 is $7/32^{nd}$ of an inch. Portion 704 is located inside of and pivots within sleeve 114. In an embodiment, portion 706 is just long enough to accommodate leg 156 (FIG. 1B). In another embodiment, portion 706 is long enough to accommodate several different width legs of different ladders, and may therefore be longer than the width of leg 156. In an embodiment, the length of portion 704 from an axis running down the center of portion 702 to an axis running down the center of portion 704 is $2\frac{19}{32}^{nd}$ of an inch. Portion 706, as a result of being bent, holds clip 112 from slipping out of sleeve 114 in one direction. Thus portion 702 prevents portion 704 from slipping out of sleeve 114 in one direction and portion 706 prevents portion 704 from slipping out of sleeve 114 in the other direction, thereby keeping portion 704 in sleeve 114. In an embodiment, the length of portion 706 from an axis running down the center of portion 704 to an axis running down the center of portion 708 is 2¼ inches.

Portion 708 extends across step 158 of the ladder 154 (FIG. 1B), and may help keep the container form tipping sideways. In an embodiment, portion 708 is just long enough to accommodate step 158. In other words, portion 708 may be as long as the width of step 158 or slightly shorter. In another embodiment, portion 708 is long enough to accommodate several different width steps of different ladders, and may therefore be longer than the width of step 158. In an embodiment, the length of portion 708 from an axis running down the center of portion 706 to an axis running down the center of portion 710 is 3¼ of an inch.

Portion 710 extends downward and holds clip 112 and container holder 100 or 200 to step 158 (FIG. 1B). In an embodiment in which portion 708 is as long as the width of step 158 or slightly shorter, portion 710 may also pull portion 704 as a result of portion 708 being only as long as the width of step 158 or slightly shorter, thereby pulling portion 706 into leg 156 (FIG. 1B), which may also help keep the container from tipping sideways. Having portion 708 slightly shorter than the width of step 158 (e.g. $1/32^{nd}$ or $1/64^{th}$ of an inch shorter) may allow clip 112 to still engage ladder 154 by slightly compressing step 158 and/or stretching clip 112 so that clip 112 is more securely fastened to ladder 154. Similarly, having portion 708 just as long the width of step 158 (e.g., but allowing for little or no tolerance) may allow clip 112 to engage ladder 154 snuggly so that clip 112 is more securely fastened to ladder 154. In an embodiment, the length of portion 710 from an axis running down the center of portion 708 to an end of portion 710 is $3\frac{1}{16}^{th}$ of an inch long or longer or in another embodiment $1\frac{23}{32}^{nd}$ or longer. Optionally, there may be a second portion parallel to portion 710 connected to the opposite side of portion 708 so that there are two portions extending downward (one of which being portion 710 and the other of which being the optional portion), one on each side of a step of the ladder, and then portion 710 may be shorter (e.g., $1\frac{23}{32}^{nd}$ of an inch long) then were the second portion extending downward not present.

FIG. 8 shows a diagram of a representation of an embodiment applicator holder 108 having magnet holder 106, sidewall 504, detail no. 2, top 801, hole 802, depression 804, and hole 806. In other embodiments, applicator holder 108 may not have all of the elements listed and/or may have other elements instead of or in addition to those listed.

Magnet holder 106 was discussed in conjunction with FIG. 1A. Side 506 was discussed in conjunction of FIG. 5. Top 801 is the top of applicator holder 108. Hole 802 engages pin 302 (FIG. 3). In an embodiment, hole 802 has a diameter of $1/8^{th}$ of an inch. Depression 804 allows pin 302 to slide along depression 804 and snap into hole 802. In an embodiment, the radius of curvature is $5/32^{nd}$ of an inch for depression 804. In an embodiment, the distance between the two edges of depression 804 is $3/32^{nd}$ of an inch. A corresponding pin on the other side of container holder 100 or 200 slides into a corresponding depression on side 506 and snaps into hole 806. Detail no. 2 shows a portion of a wall of applicator holder 108.

FIG. 9 shows a diagram of a representation of an embodiment of an enlarged view of detail no. 2 having hole 802 and depression 804. In other embodiments, detail no. 2 may not have all of the elements listed and/or may have other elements instead of or in addition to those listed. FIG. 9 shows a better view of hole 802 and depression 804 that is easier to see than in FIG. 8.

FIG. 10 shows a diagram of a representation of an embodiment of another view of magnet 104 and magnet holder 106. Magnet 104 and magnet holder 106 have hole 1002. In other embodiments, magnet 104 and magnet holder 106 may not have all of the elements listed and/or may have other elements instead of or in addition to those listed.

Magnet 104 has a rectangular shape. Magnet holder 106 covers the back of magnet 104 and two sides of magnet 104. Hole 1002 receives pin 502, which holds magnet 104 and magnet holder 106 in place. In an embodiment hole 1002 has a diameter of $3/32^{nd}$ of an inch. In an embodiment, magnet 106 holder has a height of $7/8^{th}$ of an inch and a width of $1\frac{5}{8}^{th}$ inches.

Figure 11A:
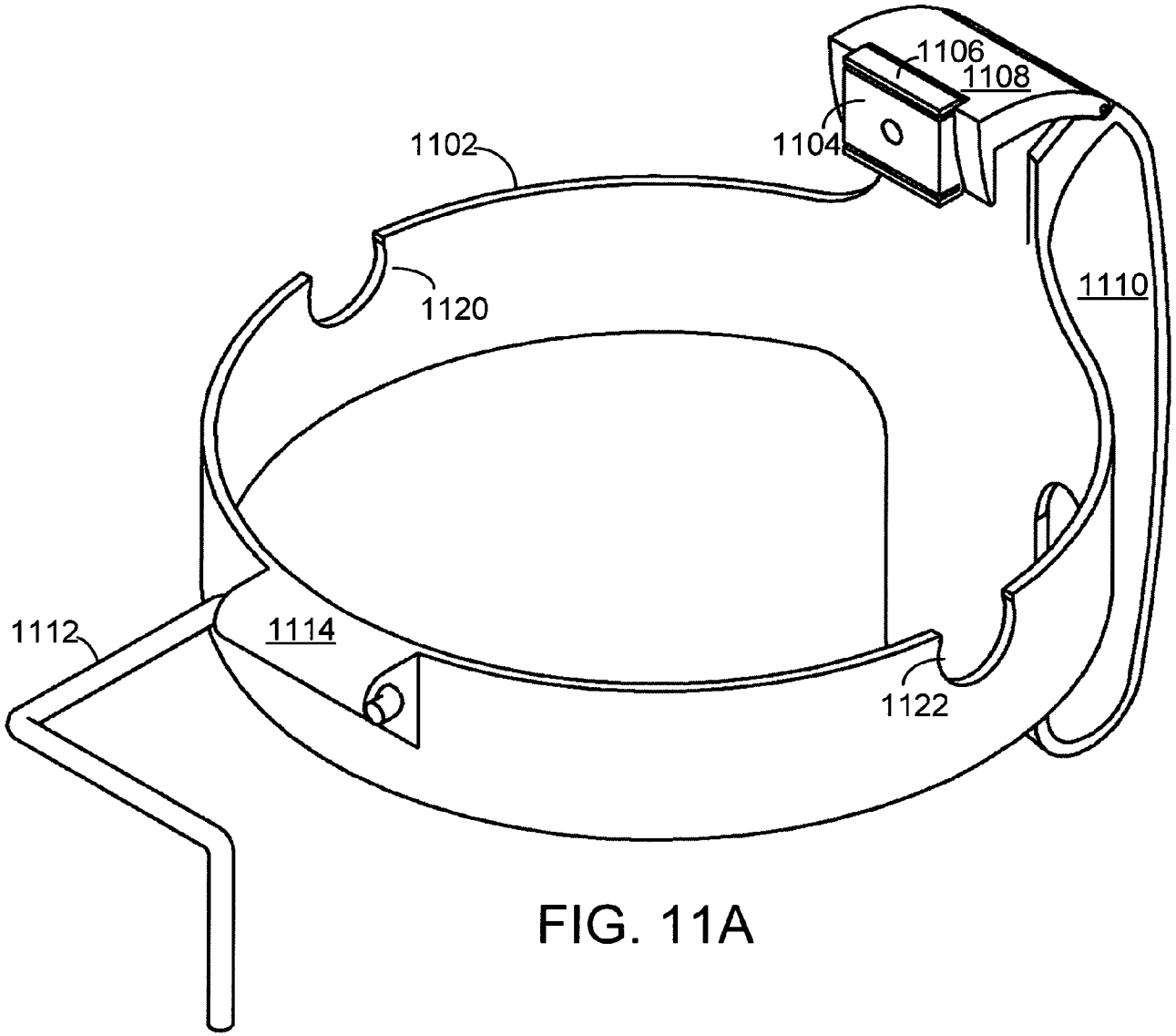
FIG. 11A shows a diagram of a representation of another embodiment of a container holder.

FIG. 11A shows a diagram of a representation of an embodiment container holder 1100, which includes band 1102, magnet 1104, magnet holder 1106, applicator holder 1108, handle 1110, clip 1112, sleeve 1114, and notches 1120 and 1122. In other embodiments, container holder 1100 may not have all of the elements listed and/or may have other elements instead of or in addition to those listed.

Container holder 1100 holds a container having protrusions where bucket handles are pivotally attached to the container. In an embodiment, container holder 1100 may hold a 1¼ gallon container of paint. Band 1102, magnet 1104, magnet holder 1106, applicator holder 1108, handle 1110, clip 1112, and sleeve 1114 are essentially the same as band 102, magnet 104, magnet holder 106, applicator holder 108, handle 110, clip 112, and sleeve 114, which were discussed in conjunction with FIG. 1A. However, band 1102, magnet 1104, magnet holder 1106, applicator holder 1108, handle 1110, clip 1112, and sleeve 1114 may have different sizes than band 102, magnet 104, magnet holder 106, applicator holder 108, handle 110, clip 112, and sleeve 114.

In an embodiment, band 1102 is $1\frac{3}{8}^{th}$ inches high. In an embodiment, the diameter of band 1102 is $6\frac{5}{8}^{th}$ inches wide. In an embodiment, magnet 1104 has a hole of diameter of $1/8^{th}$ of an inch. In an embodiment, magnet holder 1106 is 1½ inches wide and $7/8^{th}$ of an inch high. In an embodiment, applicator holder 1108 and sleeve 1114 are each the same width and are $1\frac{5}{8}^{th}$ inches wide. In an embodiment, the distance between the two inner walls of handle 1110 at its widest point is $1\frac{1}{16}^{th}$ of an inch. In an embodiment, at the point where handle 1110 meets band 1102 the wall of handle 1110 closest to band 1102 widens and forms curved portions. In an embodiment, handle 1110 has a sharp apex on the inside of handle 1110 at the top of handle 1110. In an embodiment, the side of handle 1110 that is closest to the container is straight and the wall of the handle that is further from the container is slightly curved. The two walls of handle 1110 are joined at the bottom of the handle with a region having a radius of curvature of $3/16^{th}$ of an inch. In an embodiment, above band 1102, the curved portion at the juncture between handle 1110 and band 1102 has a radius of $3/16^{th}$ of an inch, and below band 1102 the curved portion of handle 1110 has a radius of $5/16^{th}$ of an inch. In an embodiment handle 1110 extends below band 1102 a distance of $3\frac{3}{8}^{th}$ inches. In an embodiment the distance from the top of applicator holder 1108 to the bottom of handle 1110 is $6\frac{5}{8}^{th}$ inches. In an embodiment, sleeve 1114 has an outer surface with a curvature with an outer radius of $7/32^{nd}$ inches.

Notches 1120 and 1122 engage the bucket handle pivots, which hold the container in place within container holder 1100. In an embodiment, notches 1120 and 1122 have a top opening of ¾ of an inch and a diameter of $7/8^{th}$ of an inch.

Figure 11B:
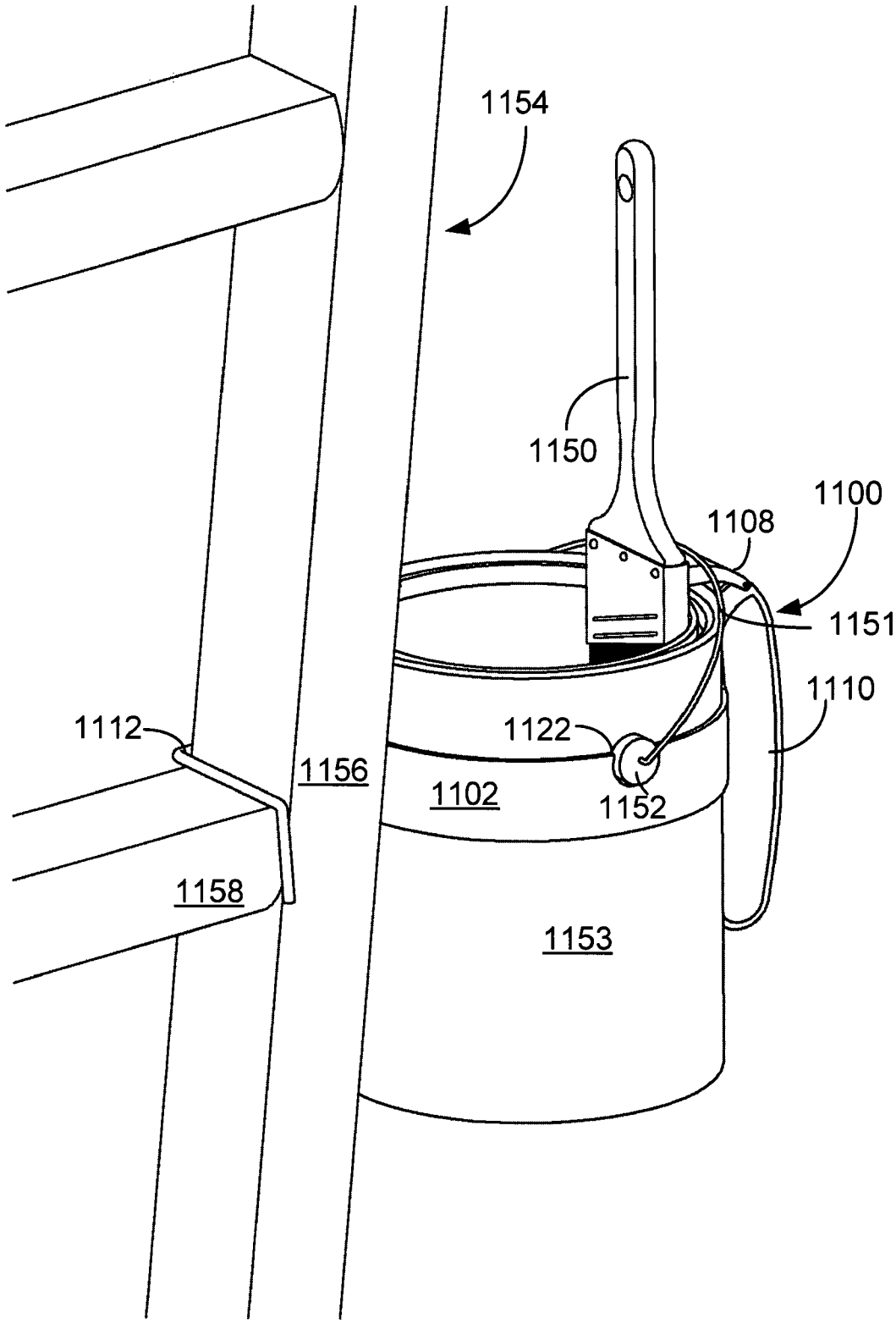
FIG. 11B shows a diagram of a representation of an embodiment of the container holder of FIG. 11A attached to a ladder.

FIG. 11B shows a diagram of a representation of an embodiment of a system including container holder 1100, which has band 1102, magnet holder 1106, applicator holder 1108, handle 1110, clip 1112, sleeve 1114, and notch 1122. The system of 11B also includes applicator 1150, handle 1151, pivot 1152, container 1153, ladder 1154, leg 1156, and step 1158. In other embodiments, container holder 1100 may not have all of the elements listed and/or may have other elements instead of or in addition to those listed.

Container holder 1100, band 1102, magnet holder 1106, applicator holder 1108, handle 1110, clip 1112, sleeve 1114, and notch 1122 were described in conjunction with FIG. 11A. The description of applicator 1150 and container 1153 are essentially the same as applicator 150 and container 152, which were described in FIG. 1B. In an embodiment, container 1153 may be a 1 and ¼ gallon can of paint. Handle 1151 may be a handle that comes with container 1153. Pivot 1152 holds handle 1151 to container 1153 while allowing handle 1151 to pivot. Handle 1153 is inconvenient to use while applying the fluid. The description of ladder 1154, leg 1156, and step 1158 are essentially the same as ladder 154, leg 156, and step 158, which were described in FIG. 1B. FIG. 11B shows the manner in which applicator container holder 1100 attaches to a ladder. Specifically, similar to FIG. 1B, clip 1112 wraps around leg 1156 and hooks onto step 1158.

Figures 12, 13:
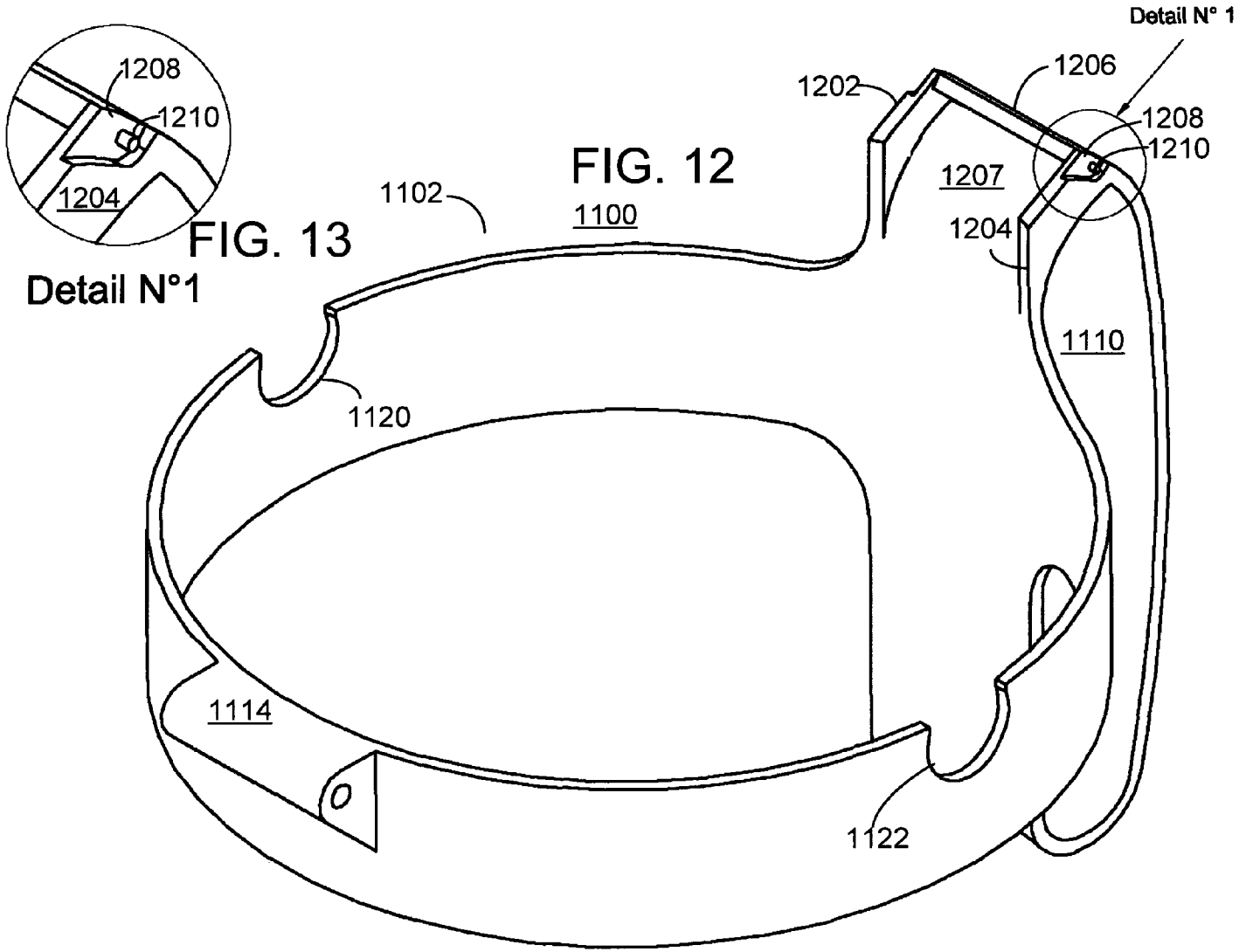
FIG. 12 shows a diagram of a representation of an embodiment of another view of the container holder of FIG. 11A.
FIG. 13 shows a diagram of a representation of an embodiment of an enlarged view of a wall the container holder of FIG. 11A.

FIG. 12 shows a diagram of a representation of an embodiment of container holder 1100, which includes band 1102, handle 1110, clip 1112, sleeve 1114, and notches 1120 and 1122. Container holder 1100 also includes walls 1202 and 1204, top portion 1206, inner handle top 1207, depression 1208, and pin 1210. In other embodiments, container holder 1100 may not have all of the elements listed and/or may have other elements instead of or in addition to those listed.

FIG. 12 shows container 1100 without clip 1114 or applicator holder 1108 so that features hidden by clip 1114 and applicator holder 1108 can be seen. Band 1102, magnet 1104, magnet holder 1106, applicator holder 1108, handle 1110, clip 1112, sleeve 1114, and notches 1120 and 1122 container holder 1100 were discussed in conjunction with FIG. 11A, above. Wall 1202 and 1204 and top portion 1206 help hold applicator holder 1108 in position. In an embodiment, walls 1202 and 1204 are $\frac{1}{8}^{th}$ of an inch thick. Inner handle top 1207 curves 75 degrees between band 1102 and the juncture of inner handle top 1207 and top portion 1206. Depression 1208 and pin 1210 are essentially the same as depression 304 and pin 302, which were discussed in conjunction with FIG. 3. Detail no. 1 includes a portion of wall 1204 having pin 1208 and depression 1210.

FIG. 13 shows a diagram of a representation of an embodiment of an enlarged view of wall 1204 having pin 1208 and depression 1210. In other embodiments, wall 1204 may not have all of the elements listed and/or may have other elements instead of or in addition to those listed. FIG. 13 shows wall 1204 having pin 1208 and depression 1210 more clearly than in FIG. 12.

FIG. 14 shows a diagram of a representation of an embodiment of applicator holder 1400 having tung 1402, magnet 1404, and applicator holder body 1406, which includes magnet holder 1408, leg 1410, leg 1412, and fold 1414. In other embodiments, applicator holder 1400 may not have all of the elements listed and/or may have other elements instead of or in addition to those listed.

Applicator holder 1400 holds a fluid applicator, while clipping onto a rim of a container, such as a paint can. In an embodiment, applicator holder 1400 is ½ inch thick at its thickest point and $1\frac{7}{8}^{th}$ tall at the tallest point. Tung 1402 is for prying the cover of the container off the can. Tung 1402 also assists in holding magnet 1404 in place. Magnet 1404 holds the applicator (e.g., a paint brush) over the container. Applicator holder body 1406 holds tung 1402 and magnet 1404 in place, and clips to the rim of the container. Magnet holder 1408 holds magnet 1404. Magnet 1404 sticks to tung 1402, which helps hold both magnet 1404 and tung 1402 in place, while magnet 1404 sits in magnet holder 1408. In an embodiment, magnet holder 1408 has sidewalls and a bottom wall that are each $\frac{1}{8}^{th}$ of an inch thick, and has a ¼ inch thick top wall. Leg 1410, leg 1412, and fold 1414 form a clip on applicator holder body 1406, which clips onto the rim of the container. Leg 1410, leg 1412, and fold 1414 may each be curved with a slightly different curvature than the rim of the container to better grip the rim.

FIG. 15 shows a diagram of a representation of a system including applicator holder 1400 having tung 1402, applicator holder body 1406, which includes leg 1410, leg 1412, fold 1414, and back 1502. In other embodiments, the system of FIG. 15 may not have all of the elements listed and/or may have other elements instead of or in addition to those listed.

Tung 1402, applicator holder body 1406, which includes leg 1410, leg 1412, fold 1414 were discussed in conjunction with FIG. 14, above. Back 1502 may be curved and may have the same curvature as leg 1410.

FIG. 16A shows a diagram of a representation of an embodiment of applicator holder 1400 having applicator holder body 1406, which includes magnet holder 1408, leg 1410, leg 1412, fold 1414, slot 1602, cavity 1604, and channel 1606. In other embodiments, the view of FIG. 16A may not have all of the elements listed and/or may have other elements instead of or in addition to those listed.

Holder body 1406, which includes magnet holder 1408, leg 1410, leg 1412, and fold 1414 were discussed in conjunction with FIG. 14. Slot 1602 receives tung 1402. In an embodiment slot 1602 is a ½ inch wide. Tung 1402 is inserted into slot 1602. In an embodiment, tung 1602 is ½ inch wide. In an embodiment, tung 1402 extends above holder body 1406 by $\frac{3}{8}^{th}$ of an inch. Cavity 1604 receives magnet 1404. In an embodiment, cavity 1604 is $1\frac{1}{32}^{nd}$ of an inch wide. In an embodiment, cavity 1604 is $\frac{23}{32}^{nd}$ of an inch high. In an embodiment, cavity 1604 is $\frac{1}{8}^{th}$ of an inch deep without channel 1606. Channel 1606 receives and holds tung 1402 after tung 1402 is inserted into slot 1602.

Figure 16B:
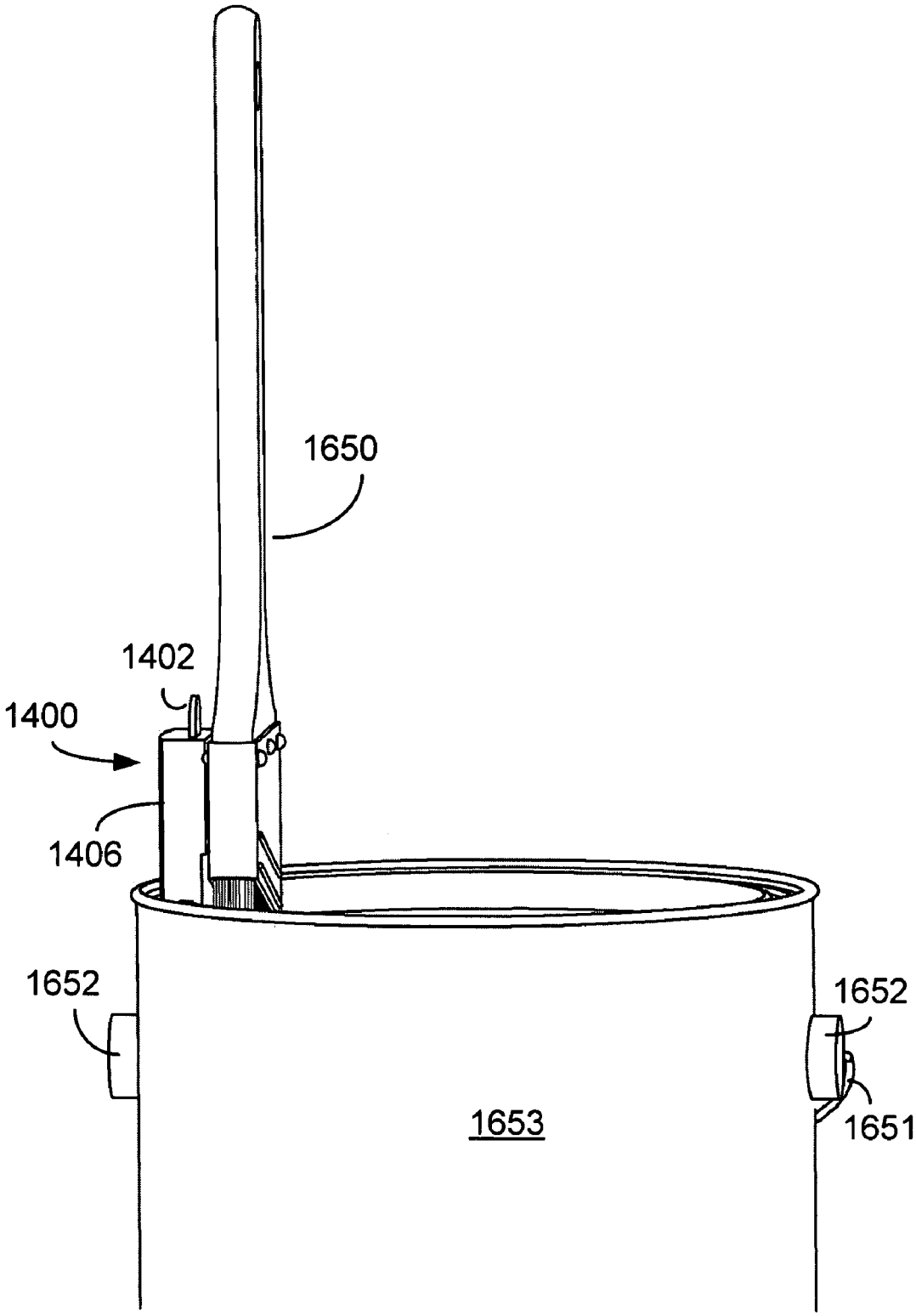
FIG. 16B shows a diagram of a representation of an embodiment of another view of the applicator holder of FIG. 14 attached to a container.

FIG. 16B shows a diagram of a representation of a system including applicator holder 1400 having tung 1402, and applicator holder body 1406. The system of FIG. 16B also includes applicator 1650, handle 1651, pivot 1652, and container 1653. In other embodiments, the system of FIG. 16B may not have all of the elements listed and/or may have other elements instead of or in addition to those listed.

Applicator holder 1400, tung 1402, and applicator holder body 1406 were described in conjunction with FIG. 14. The description of applicator 1650, handle 1651, pivot 1652, and container 1653 are essentially the same as applicator 1150, handle 1151, pivot 1152, and container 1153, which were described in FIG. 1B. FIG. 16B shows the manner in which applicator holder 1400 attaches to container 1153 and holds applicator 1650 in place. Specifically, similar to FIG. 16B, applicator holder 1400 attaches to the rim of container 1653 and holds applicator 1650 over the contents of container 1653.

FIG. 17 shows a diagram of a representation of an embodiment of tung 1402, which is shaped like a thin tablet. In other embodiments, tung 1402 may not have all of the elements listed and/or may have other elements instead of or in addition to those listed. In an embodiment, tung 1402 has a rectangular shape with a semicircular top portion. In an embodiment tung 1402 is $\frac{13}{32}^{nd}$ of an inch tall. In an embodiment, tung 1402 is $\frac{3}{32}^{nd}$ of an inch thick.

FIG. 18 shows a diagram of a representation of an embodiment of magnet 1404, which has a rectangular shape. In other embodiments, magnet 1404 may not have all of the elements listed and/or may have other elements instead of or in addition to those listed.

FIG. 19 shows a diagram of a representation of an embodiment of a front view of applicator holder 1900 having magnet holder 1408, leg 1410, leg 1412, slot 1602, cavity 1604, channel 1606, and cylindrical bumps 1902*a-j*. In other embodiments, front view of applicator 1900 may not have all of the elements listed and/or may have other elements instead of or in addition to those listed.

Applicator holder 1900 is similar to applicator holder 1400 except applicator holder 1900 has cylindrical bumps and applicator holder 1400 does not. Magnet holder 1408, leg 1410, leg 1412, and fold 1412, were discussed in conjunction with FIG. 14, and slot 1602, cavity 1604 and channel 1606 were discussed in conjunction with FIG. 16A, above. Cylindrical bumps 1902*a-j* press against magnet 1406 (e.g., thereby compressing magnet 1406, compressing and/or stretching magnet holder 1408, and/or compressing cylindrical bumps 1902*a-j*) or otherwise creating a frictional force, which helps hold the magnet in place (similar to cylindrical bumps 202 and 518). In an embodiment, cylindrical bumps 1902*i* and 1902*j* have their centers $9/32^{nd}$ of an inch apart, and cylindrical bumps 1902*d* and 1902*e* have their centers $9/32^{nd}$ of an inch apart. In an embodiment, cylindrical bumps 1902*a* and 1902*b* have their centers $11/32^{nd}$ of an inch apart, and cylindrical bumps 1902*b* and 1902*c* have their centers $11/32^{nd}$ of an inch a part. Similarly, in an embodiment, cylindrical bumps 1902*f* and 1902*g* have their centers $11/32^{nd}$ of an inch apart, and cylindrical bumps 1902*g* and 1902*h* have their centers $11/32^{nd}$ of an inch apart.

FIG. 20 shows a diagram of a representation of an embodiment of a sectional view of applicator holder 1900 having magnet holder 1408, leg 1410, leg 1412, fold 1414, slot 1602, cavity 1604, channel 1606, and cylindrical bumps 1902*b*, 1902*g*, 1902*i* and 1902*j*. In other embodiments, sectional view of applicator holder 1900 may not have all of the elements listed and/or may have other elements instead of or in addition to those listed.

Magnet holder 1408, leg 1410, leg 1412, and fold 1412 were discussed in conjunction with FIG. 14, slot 1602, cavity 1604, and channel 1606 were discussed in conjunction with FIG. 16A, and cylindrical bumps 1902*b*, 1902*g*, 1902*i* and 1902*j* were discussed in conjunction with FIG. 19. However, in FIG. 20 the cylindrical nature of cylindrical bumps 1902*b*, 1902*g*, 1902*i* and 1902*j* can be seen better than in FIG. 19. In an embodiment, the bottom portion of the cross section of leg 1410 is rounded having a radius of $3/32^{nd}$ of an inch.

FIG. 21 shows a diagram of a representation of an embodiment of a bottom view of applicator holder 1400 having magnet holder 1408, leg 1410, leg 1412, fold 1414, and gap 2102. In other embodiments, bottom view of applicator holder 1900 may not have all of the elements listed and/or may have other elements instead of or in addition to those listed.

Magnet holder 1408, leg 1410, leg 1412, and fold 1414 were discussed in conjunction with FIG. 14, above. Additionally, FIG. 21 shows the degree of curvature to which leg 1410, leg 1412, and fold 1412 are curved. Gap 2102 is a gap formed between leg 1410 and fold 1412. In an embodiment, gap 2102 is $1/16$ of an inch wide. A portion of the rim of the container is inserted into gap 2102. Leg 1412 has an inner radius $11/16^{th}$ of an inch and an outer radius of $25/32^{nd}$ of an inch, which is the inner radius of folded portion 1414. In an embodiment, the outer radius of folded portion 1414 is $7/8^{th}$ of an inch. The inner radius of leg 1410 is $29/32^{nd}$ of an inch and the outer radius of leg 1410 is $31/32^{nd}$ of an inch. In an embodiment, leg 1410 is $5/32^{nd}$ of an inch thick. In an embodiment, leg 1410 and leg 1412 are $1/8^{th}$ of an inch apart from one another. In an embodiment leg 1412 is $7/32^{nd}$ of an inch long and extends $1/8^{th}$ of an inch upwards before folded portion 1414 begins.

Figure 22:
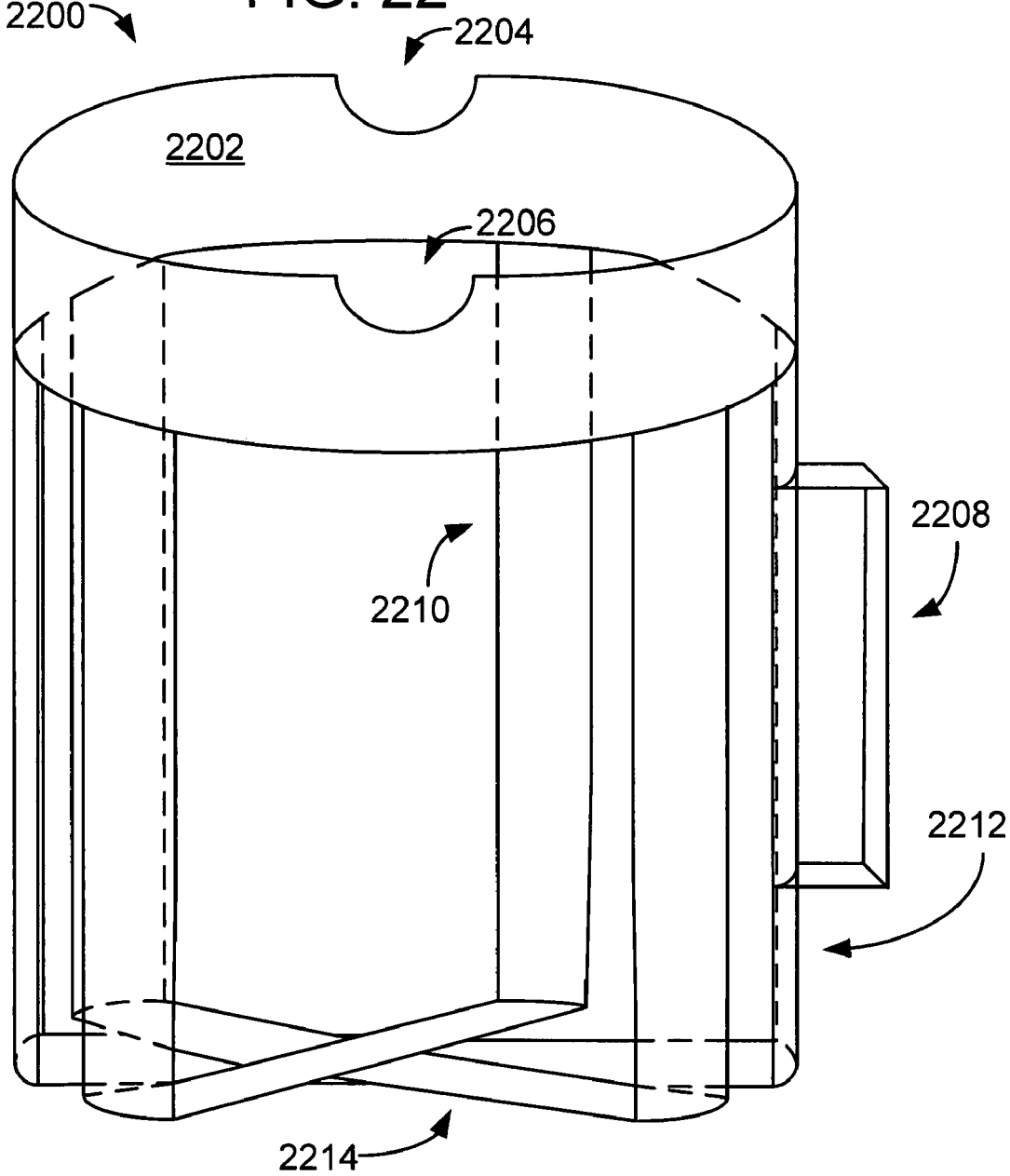
FIG. 22 shows a diagram of a representation of another embodiment of a container holder.

FIG. 22 shows a diagram of a representation of an embodiment of another container holder 2200 having band 2202, notches 2204 and 2206, handle 2208, and straps 2210, 2212, and 2214. In other embodiments, container holder 2200 may not have all of the elements listed and/or may have other elements instead of or in addition to those listed.

Container holder 2200 includes both straps and notches. Specifically, in an embodiment, band 2202 may wrap around the container. In an embodiment, notches 2204 and 2206 may be located at the top of band 2202 and may receive and/or engage the pivot points of a bucket-type handle that is sold with the container. Container holder 2200 may be held by handle 2208. In an embodiment, band 2202 may be attached to one or more strips of a material that forms straps 2210-2214, and each strip has one end attached to one side of the band 2202, and the other end may attach to an opposite end of the band 2202, as shown in FIG. 22. Strap 2212 may support handle 2208 and may have handle 2208 attached. Straps 2210-2214 may form a basket that receives the container. In an embodiment, the handle 2208 may be used in addition to or instead of a bucket-type handle attached to the container. In another embodiment, the holder is one continuous piece of material that forms a cup for receiving and holding the container.

Figure 23:
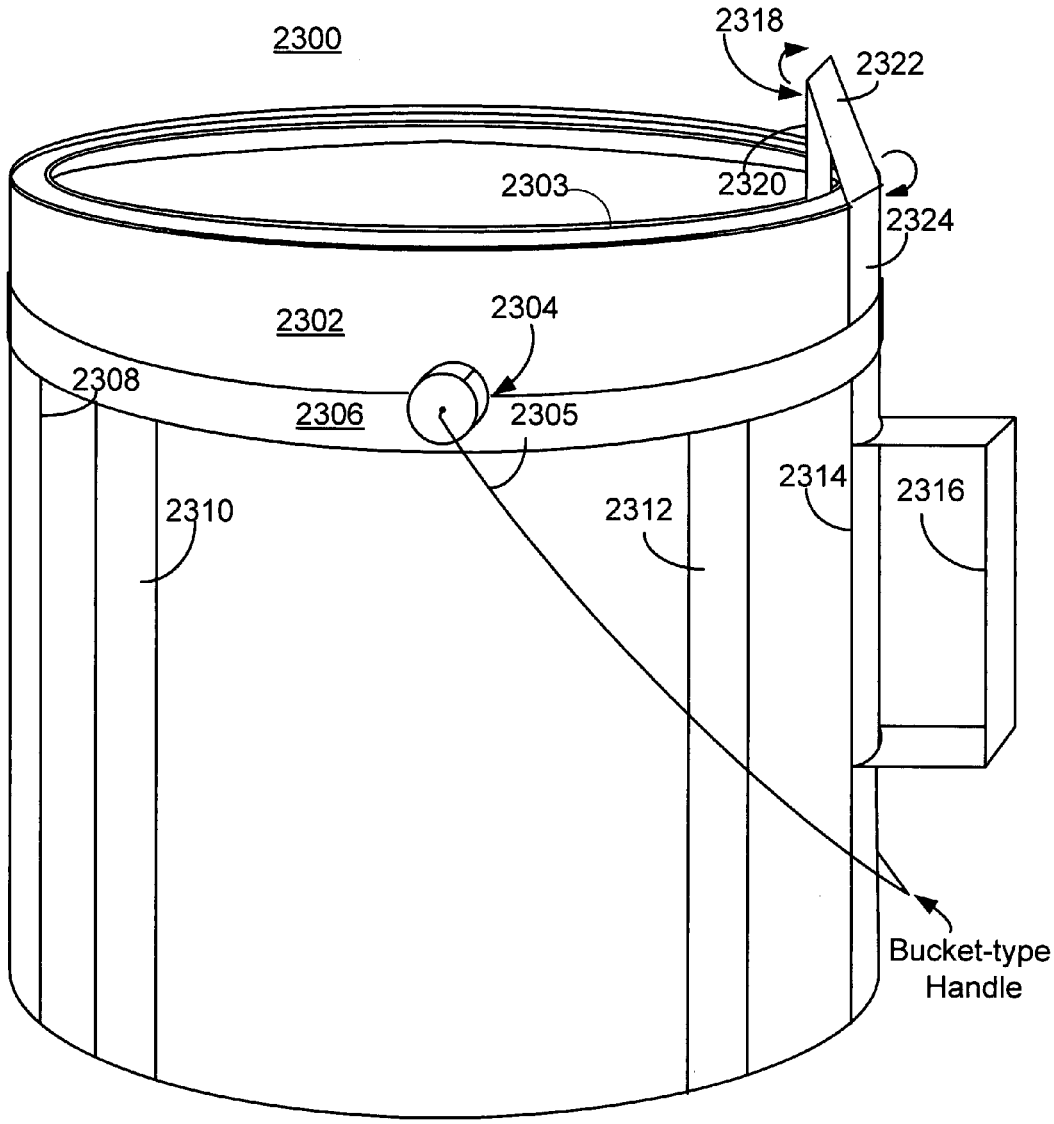
FIG. 23 shows a diagram of a representation of another embodiment of a container holder.

FIG. 23 shows a diagram of a representation of an embodiment of system 2300, which may include container 2302 having rim 2303. System 2300 also includes pivot 2304, handle 2305, band 2306, straps 2308-2314, handle 2316, applicator holder 2318, magnetic card 2320, card 2322, and strip 2324. In other embodiments, system 2300 may not have all of the elements listed and/or may have other elements instead of or in addition to those listed.

In system 2300, attached to the holder, the handle, and/or the container is a piece of material that bends and may hang by the side of the container. Specifically, container 2302 may contain a fluid and may have rim. Rim 2303 may be used to secure a lid (not shown) to container 2302. Pivot 2304 may pivotally connect handle 2305 to container 2302. Handle 2305 may be used for carrying container 2302 and may come with container 2302. Band 2306, straps 2308-2314, and handle 2316 have a similar function as band 2202, straps 2210, 2212, and 2214, and handle 2208, respectively, which were discussed in conjunction with FIG. 22. Applicator holder 2318 may be used to hold the fluid applicator. Magnetic card 2320 may hold the applicator over container 2302. The bottom of magnetic card 2320 may engage rim 2303, and magnetic card 2320 may be held in place by a combination of rim 2303, card 2322, and strip 2324. Card 2322 is pivotally attached to magnetic card 2320 and strip 2324, which allows card 2322 and magnetic card 2322 to hang down from the side of container 2302 when applicator holder 2318 is not in use.

The piece of material may bend upward so that one end attaches to the rim of the container in a manner such that the applicator holder is positioned to hold the applicator over the fluid, as indicated in FIG. 23. This way when the crafts person using the applicator wants to temporarily stop applying the fluid, the applicator may be held over the fluid, so that the fluid dripping from the applicator will drip back into the container without making a mess. FIG. 23 shows circular arrows near the crease lines or hinges on connecting magnetic card 2320, card 2322, and strip 2324 which form applicator holder 2318. These arrows indicate the manner in which magnetic card 2320, card 2322, and strip 2324 unfold and/or fold from the position shown in FIG. 23 to a position in which the applicator holder hangs at the side of container 2302.

Figure 24:
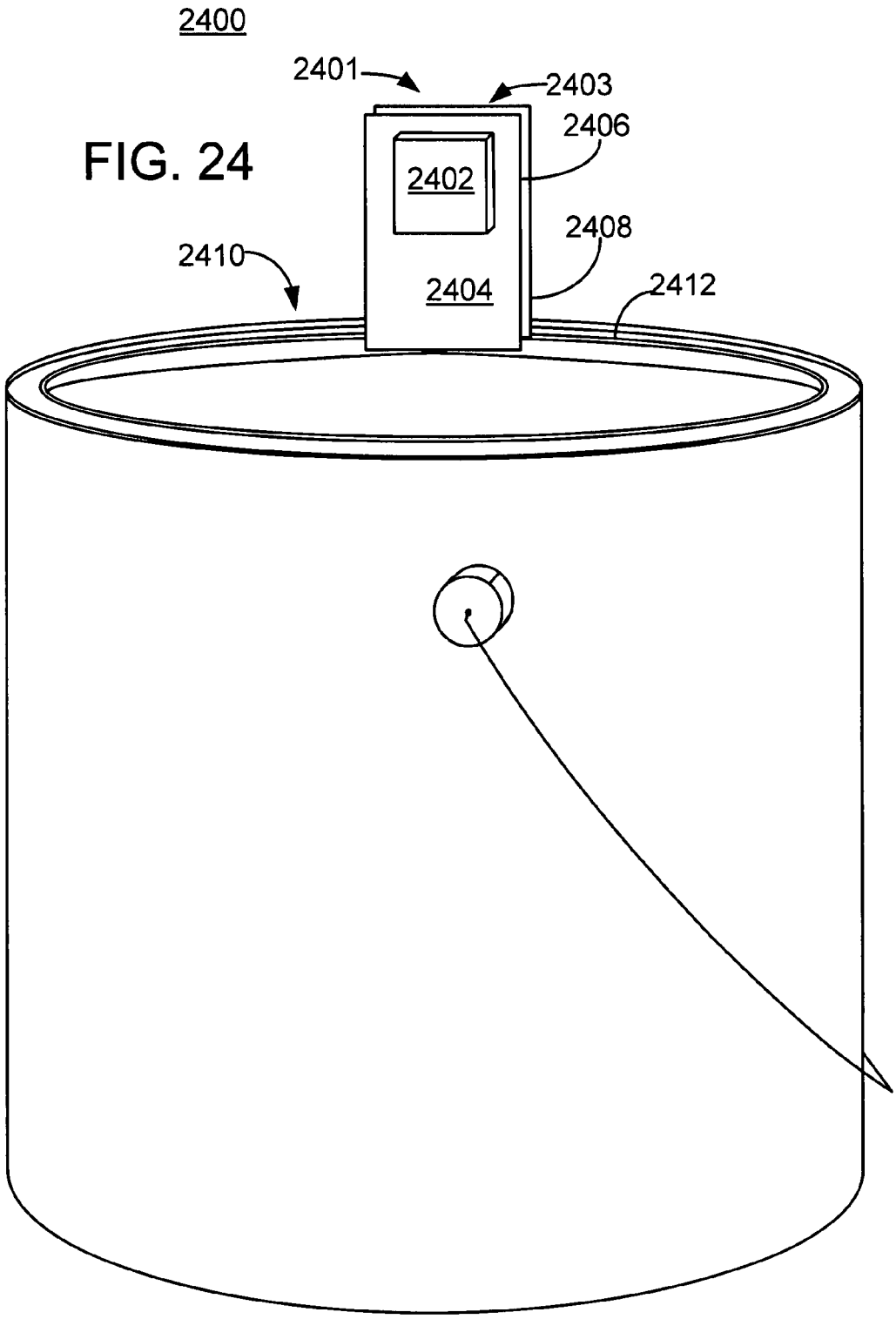
FIG. 24 shows a diagram of a representation of another embodiment of an applicator holder.

FIG. 24 shows a diagram of a representation of an embodiment of system 2400 having applicator holder 2401 including magnet 2402, card 2404, groove 2406, card 2408, and container 2410 having rim 2412. In other embodiments, system 2400 may not have all of the elements listed and/or may have other elements instead of or in addition to those listed.

System 2400 is an example of yet another embodiment in which applicator holder 2401 is not attached to any container holder, container, or handle, and may be used with or without a handle and/or a container holder. In an embodiment, applicator holder 2401 includes magnet 2402 that is attached to a rigid piece of material 2403 that has a groove on at least one edge of rigid piece of material 2403. In an embodiment, a card 2404 supports magnet 2402. Behind card 2404 is groove 2406. Card 2404 is attached via another piece of material to card 2408 to thereby form groove 2406. Groove 2406 engages container 2410 by engaging rim 2412, and holds the applicator holder 2403 in place, while the applicator holder 2403 is holding the applicator over the fluid. In FIG. 24 all of the edges of applicator holder 2403 have grooves that may engage the rim 2412, so that the user does not have to be concerned about which edge engages the container 2410. In an embodiment, applicator holder 2318 (FIG. 23) may be included in applicator holder 2403, and applicator holder 2403 may be attached to, and hang from, one end of card 2320 and may hang from one side of container 2410 when the applicator holder is not in use.

Figure 25:
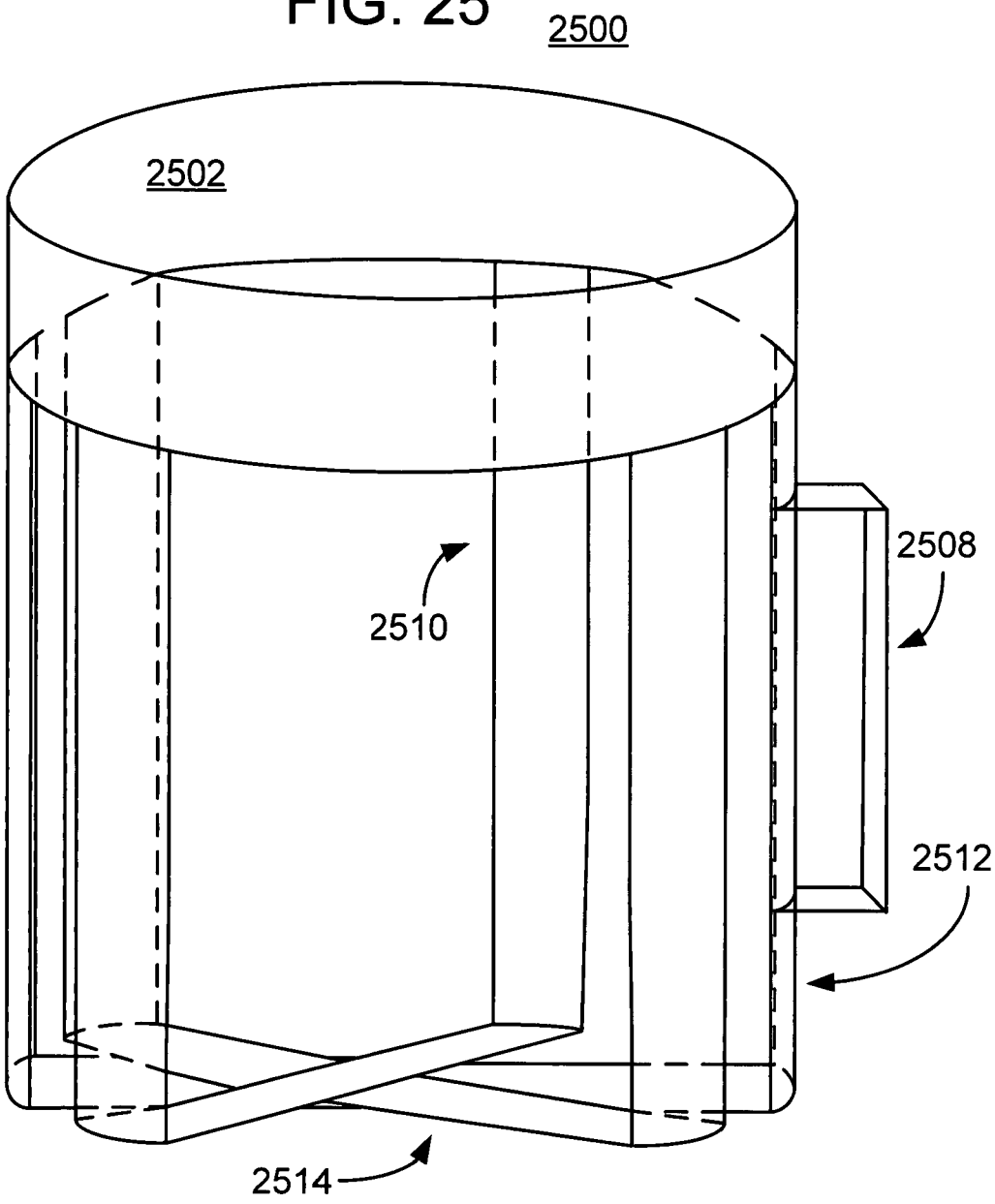
FIG. 25 shows a diagram of a representation of another embodiment of a container holder.

FIG. 25 shows a diagram of a representation of an embodiment of another container holder 2500 having band 2502, handle 2508, and straps 2510, 2512, and 2514. In other embodiments, container holder 2500 may not have all of the elements listed and/or may have other elements instead of or in addition to those listed.

The embodiment of FIG. 25 is nearly the same as the embodiment of FIG. 22. However, the embodiment of FIG. 25 does not have the notches. Band 2502, handle 2508, and straps 2510, 2512, and 2514 function in the same manner band 2202, handle 2208, and straps 2210, 2212, and 2214, which were discussed in conjunction with FIG. 22.

Figure 26:
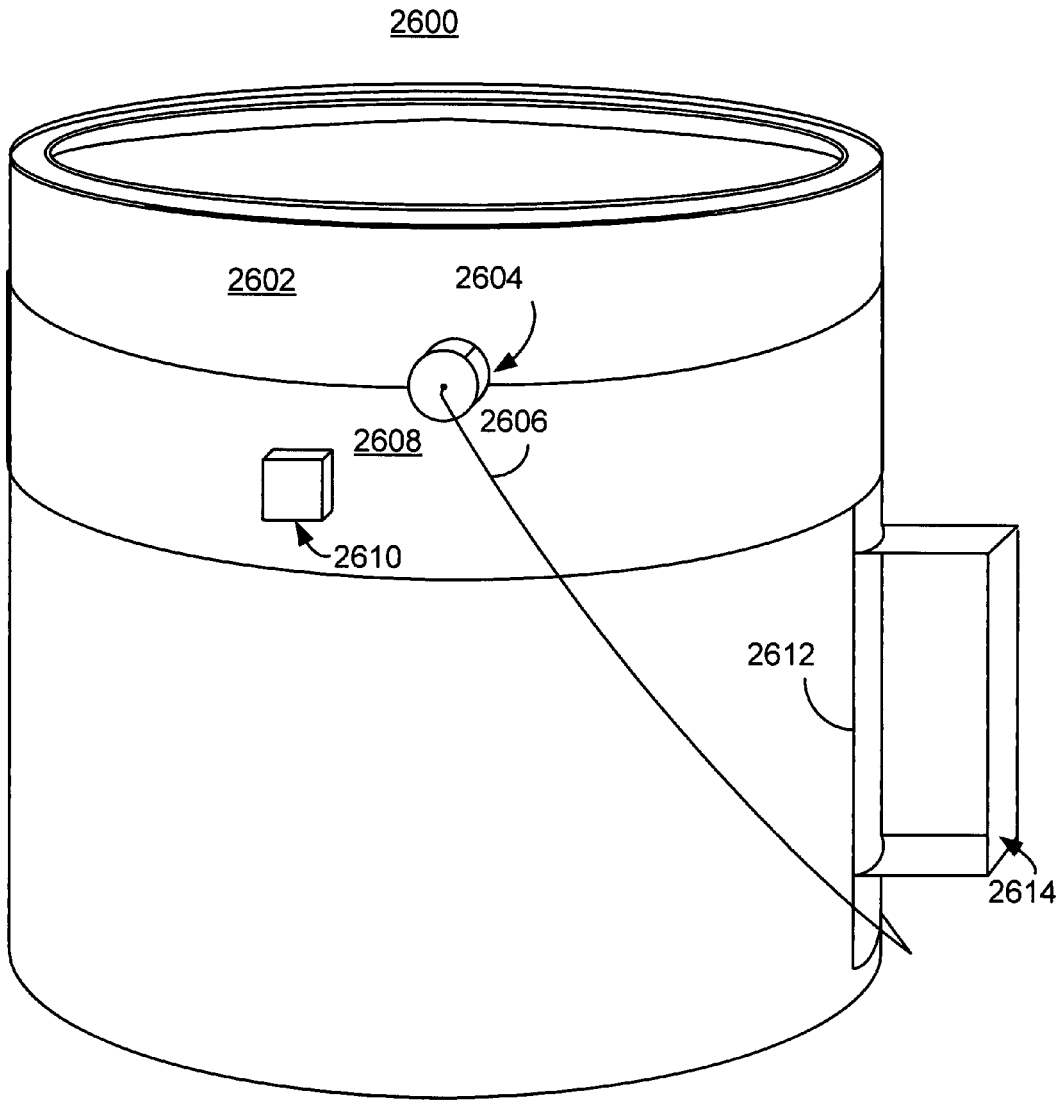
FIG. 26 shows a diagram of a representation of another embodiment of a container holder.

FIG. 26 shows a diagram of a representation of an embodiment of system 2600, which may include container 2602 having pivot 2604, handle 2606, band 2608, magnet 2610, strip 2612, and handle 2614. In other embodiments, system 2600 may not have all of the elements listed and/or may have other elements instead of or in addition to those listed.

Container 2602, pivot 2604, handle 2606, band 2608, strip 2612, and handle 2614 function in essentially the same manner as container 2302, pivot 2304, handle 2305, band 2306, and handle 2316, which were discussed in conjunction with FIG. 23.

The embodiment of FIG. 26 is similar to the embodiment of FIG. 23. However, system 2600 includes magnet 2610 located on band 2306, and there are no strips attached to band 2306. Instead, band 2608 grips the container and/or the bucket-type handle prevents the container from sliding through the band 2608. In an embodiment band 2608 includes notches that engage pivots, such as a notch to engage pivot 2604. In another embodiment, the notches are absent.

Figure 27:
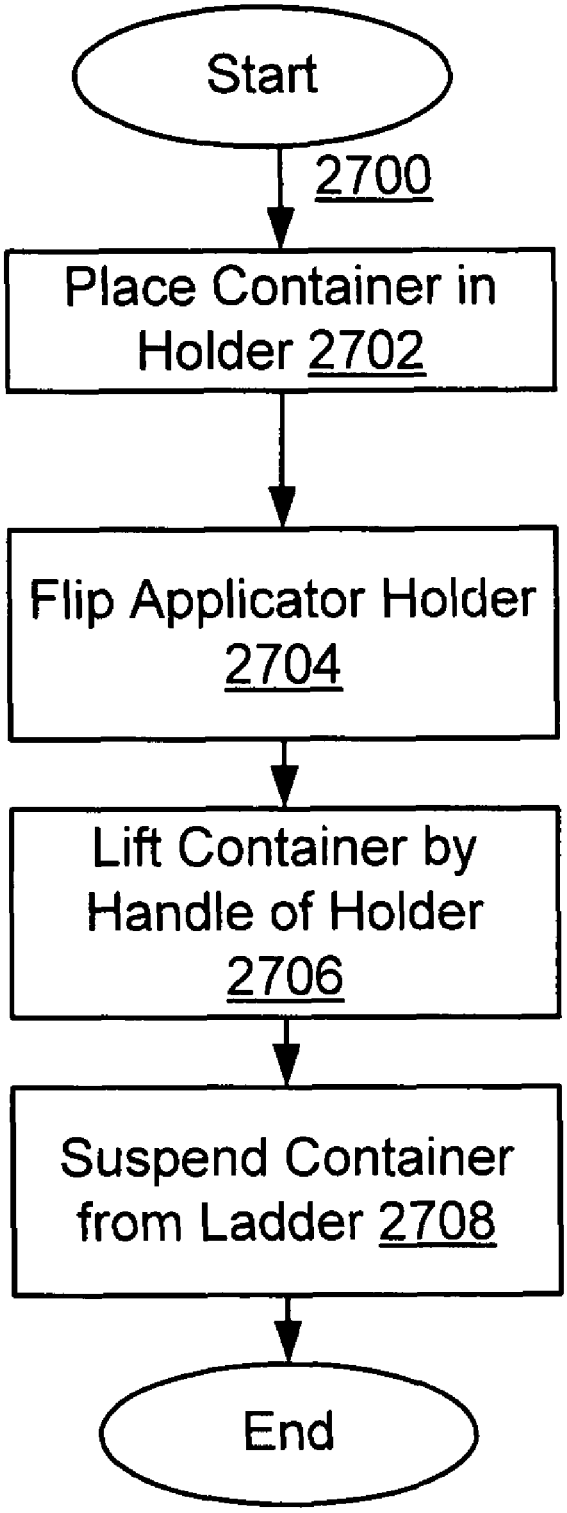
FIG. 27 shows a flowchart of an embodiment of a method for using a container holder.

FIG. 27 shows a flowchart of an embodiment of a method 2700 for using a container holder. In step 2702 the container is placed in the container holder. Step 2702 may include placing pivots for the container's handles in notches of the container holder. In optional step 2704, the applicator is attached to the applicator holder. Optional step 2704 may involve flipping the applicator holder into a position with the magnet over the container. Optional step 2704 may also involve suspending the applicator (e.g. via a magnetic attraction of the magnet of the applicator holder to the applicator) over the container, with the applicator in the fluid being applied or with the applicator above the fluid. In optional step 2706, the container is lifted with the handle of the container holder, while optionally applying the fluid in the container. In optional step 2708, container holder is suspended from a step on a ladder with clip 112 (FIG. 1A or 1B) or 1112 (FIG. 11A or 11B). In an embodiment, each of the steps of method 2700 is a distinct step. In another embodiment, although depicted as distinct steps in FIG. 27, step 2702-2708 may not be distinct steps. In other embodiments, method 2700 may not have all of the above steps and/or may have other steps in addition to or instead of those listed above. The steps of method 2700 may be performed in another order. Subsets of the steps listed above as part of method 2700 may be used to form their own method.

Figure 28:
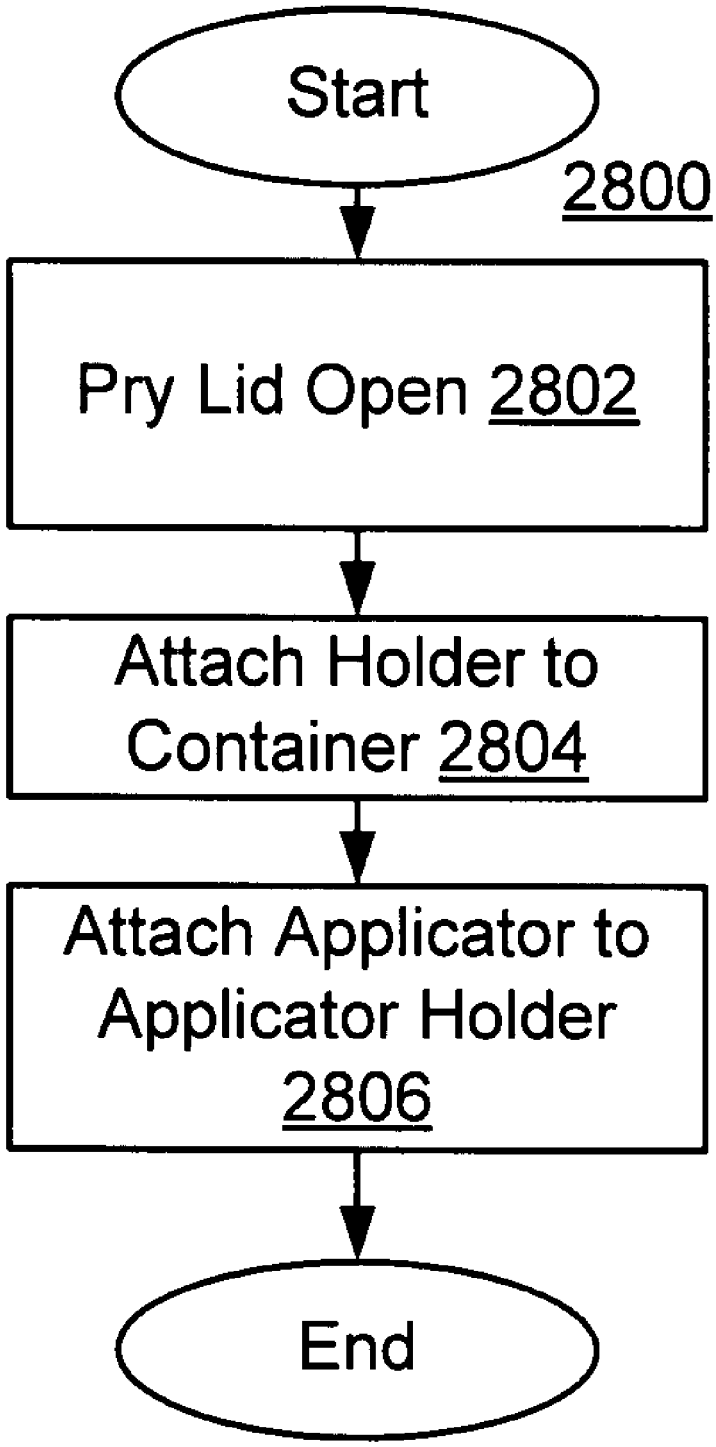
FIG. 28 shows a flowchart of an embodiment of a method of using applicator holder of FIG. 14.

FIG. 28 shows a flowchart of an embodiment of a method of using applicator holder 1400 (FIG. 14). In step 2802, the container is opened by prying the lid off with tung 1402 (FIG. 14). In step 2804, applicator holder 1400 is clipped to the rim of the container. In step 2806, the applicator is suspended over the container by attaching the applicator to the magnet of applicator holder 1400. In an embodiment, each of the steps of method 2800 is a distinct step. In another embodiment, although depicted as distinct steps in FIG. 28, step 2802-2808 may not be distinct steps. In other embodiments, method 2800 may not have all of the above steps and/or may have other steps in addition to or instead of those listed above. The steps of method 2800 may be performed in another order. Subsets of the steps listed above as part of method 2800 may be used to form their own method.

Figure 29:
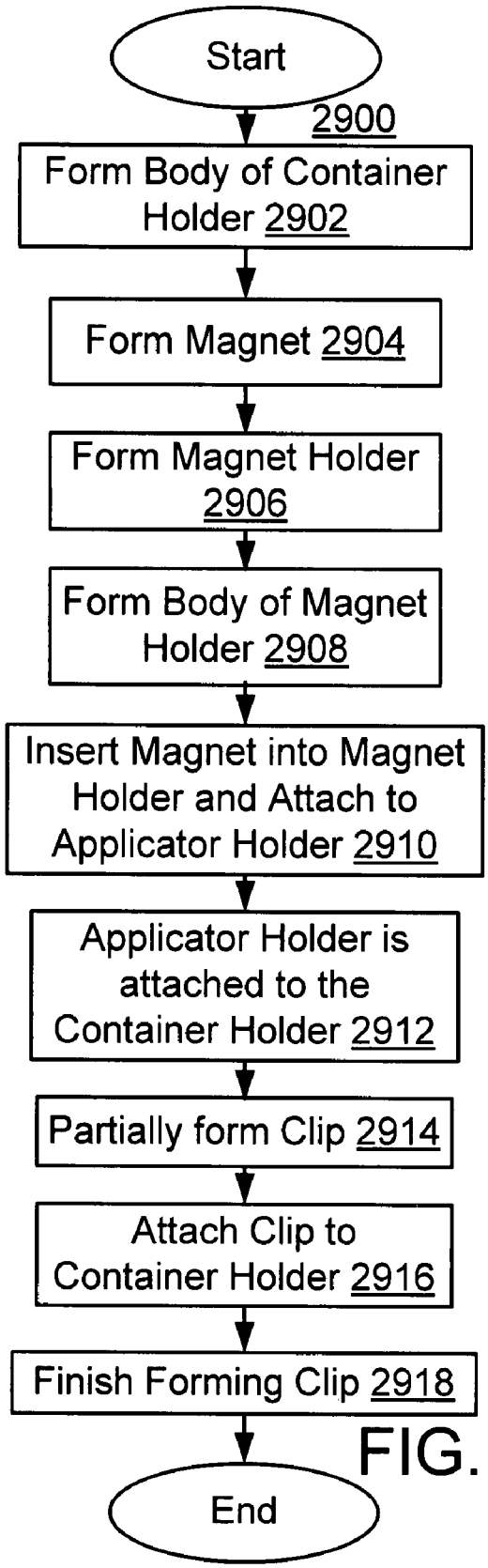
FIG. 29 shows a flowchart of an embodiment of a method of making a container holder.

FIG. 29 shows a flowchart of an embodiment of a method 2900 of making a container holder. In step 2902, the body of container holder is formed. Step 2902 may include forming a band within which the container is placed. Optionally notches may be formed in the band. Step 2902 may also optionally include forming strips that attach to a bottom portion on which the container rests. Optionally, forming the strips may include forming cylindrical bumps on the strips. Optionally, forming the bottom portion may include forming a straight portion and a ring portion. In another embodiment, the bottom portion is formed by portions of the strips that extend under the container. Optionally, step 2902 may include forming a sleeve for a clip.

In step 2904, the magnet is formed. Forming the magnet may include forming a hole in the center of the magnet. In step 2906 the magnet holder is formed. In step 2908 the body of the magnet holder is formed, which may include forming sidewalls that have holes and depressions at their ends. Step 2908 may include forming an area where a magnet and magnet holder can be attached. Step 2908 may include forming a pin that has a head on the pin, where the pin is located within the region for the magnet. In step 2910, the magnet is inserted into the magnet holder (thereby forming the applicator holder), which is attached to the body of the applicator holder by inserting the pin with the head into a hole in the magnet holder and in a hole in the magnet. In step 2912, the applicator holder is attached to the container holder. In optional step 2914, a clip is partially formed. Step 2914 may involve bending a piece of metal 90 degrees to form portions 710, 708, 706, and 704 while leaving the bend dividing portion 702 and 704 unbent. In step 2916, the clip is attached to the container holder. In an embodiment, in step 2916, portion 704 is placed into a channel of a sleeve of the container holder. In step 2918 the forming of the clip is completed. In an embodiment, in step 2918 the end of the clip is bent to form portion 702 holding the clip in the sleeve. In an embodiment, each of the steps of method 2900 is a distinct step.

In another embodiment, although depicted as distinct steps in FIG. 29, steps 2902-2918 may not be distinct steps. In other embodiments, method 2900 may not have all of the above steps and/or may have other steps in addition to or instead of those listed above. The steps of method 2900 may be performed in another order. Subsets of the steps listed above as part of method 2900 may be used to form their own method.

Figure 30:
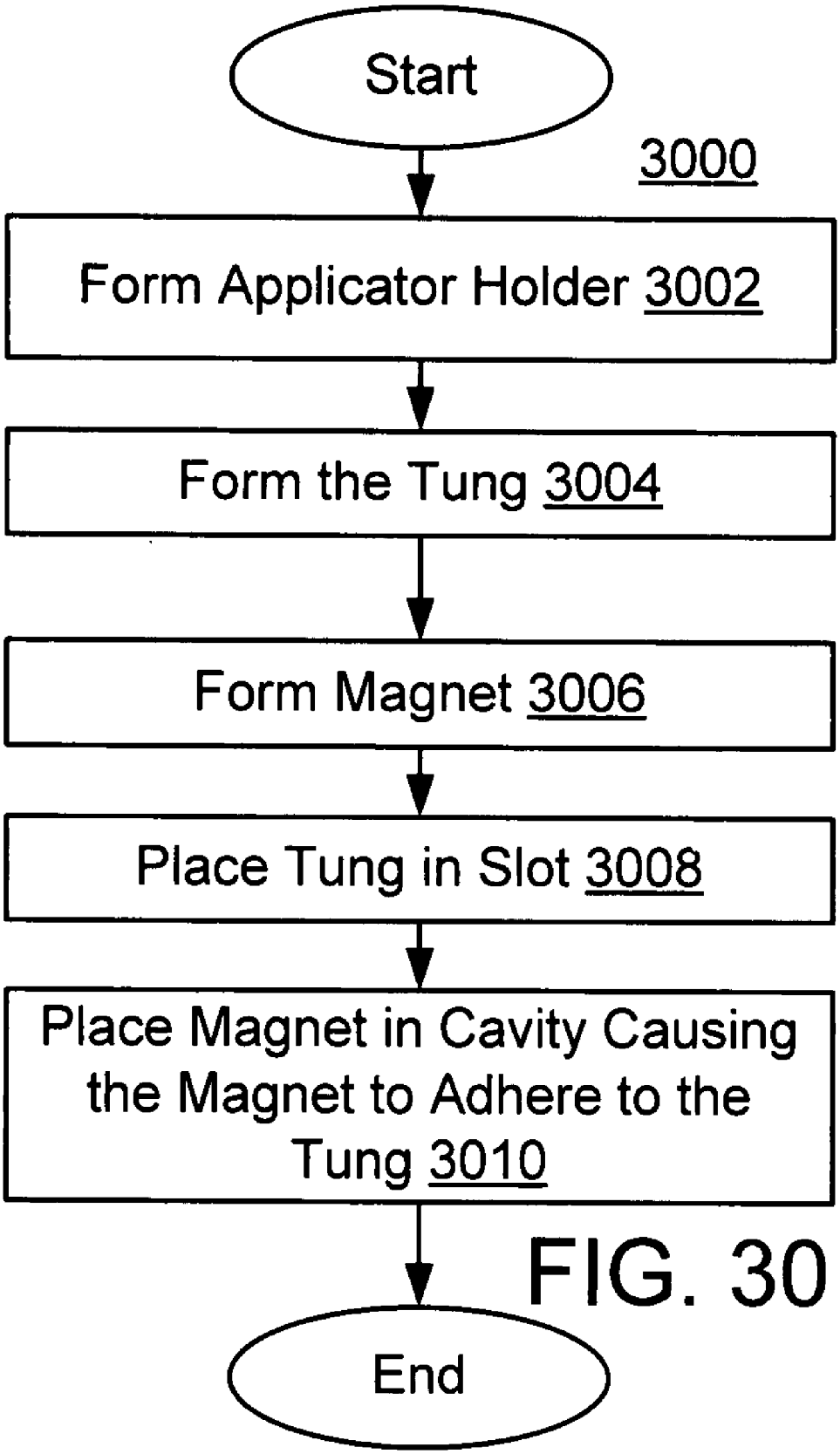
FIG. 30 shows a flowchart of an embodiment of a method of making applicator holder of FIG. 14.

FIG. 30 is a flowchart of an embodiment of a method 3000 of making applicator holder 1400 (FIG. 14). In step 3002, applicator holder body 1406 is formed, which may include forming magnet holder 1408, legs 1410 and 1412, fold 1414, slot 1602, cavity 1604, and channel 1606. Optionally, step 3002 may include forming cylindrical bumps within cavity 1604. In step 3004, tung 1402 is created. In step 3006, magnet 1404 is formed. In step 3008, tung 1402 is inserted into slot

1602 and channel 1606. In step 3010, magnet 1404 is inserted into cavity 1604 and adhered to tung 1402. In an embodiment, each of the steps of method 3000 is a distinct step. In another embodiment, although depicted as distinct steps in FIG. 30, step 3002-3010 may not be distinct steps. In other embodiments, method 3000 may not have all of the above steps and/or may have other steps in addition to or instead of those listed above. The steps of method 3000 may be performed in another order. Subsets of the steps listed above as part of method 3000 may be used to form their own method.

Clips 112 and 1112 and sleeves 114 and 1114 may be replaced by other clips, clamps, and/or other mechanism for securing a container holder to a ladder.

Figure 31F:
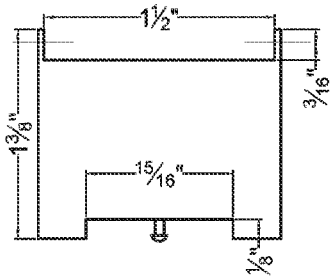
Figure 31F:
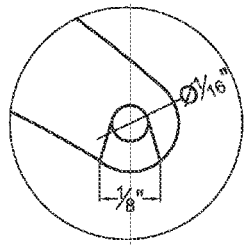
Figure 31H:
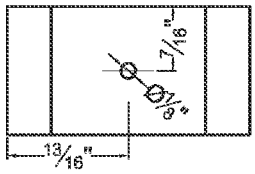
Figure 31H:
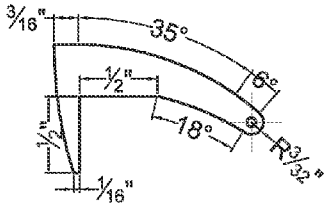
Figure 31H:
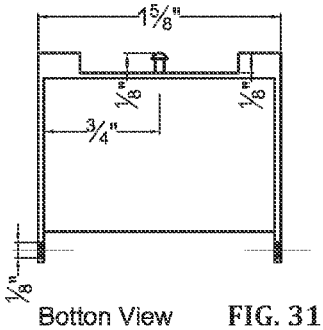
Figure 31H:
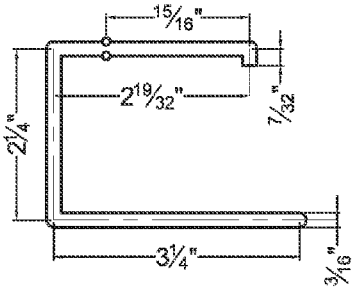
Figure 31H:
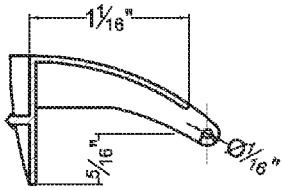
Figure 31H:
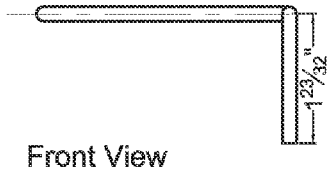

FIGS. 31A-31F show dimensions of an embodiment of applicator holder 108 of FIG 1A. FIGS. 31G and 31H show dimensions of an embodiment of clip 112 of FIG. 1A.

Each embodiment disclosed herein may be used or otherwise combined with any Of the other embodiment disclosed. Any elements of an embodiment may be used in any Embodiment.

Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A system comprising:

a piece of material having a clip for attaching to a rim of a container;

an applicator holder attached to the piece of material; and a tongue for opening the container;

the piece of material having a slot and a channel for receiving the tongue, the slot opening into the channel, the tongue sliding in and out of the channel of the piece of material, via the slot, such that the tongue is removably attached to the piece of material, such that sliding the tongue out of the slot completely detatches the tongue from the piece of material.

2. The system of claim 1, the applicator holder including a magnet;

the tongue being made from a material that is attracted to the magnet;

the piece of material having a cavity for accepting the magnet, the cavity opening to a channel for receiving the tongue, allowing the tongue to be attracted to the magnet, so that the tongue and magnet hold one another in place.

3. The system of claim 2, wall of the cavity having cylindrical bumps for keeping the magnet in place.

* * * * *